US010190346B2

(12) United States Patent
Clark

(10) Patent No.: US 10,190,346 B2
(45) Date of Patent: Jan. 29, 2019

(54) LINK ASSEMBLY FOR SYNCHRONIZING A CABINET TOE KICK PLATE WITH A DOOR OF THE CABINET

(71) Applicant: Christopher Steven Clark, Round Rock, TX (US)

(72) Inventor: Christopher Steven Clark, Round Rock, TX (US)

( * ) Notice: Subject to any disclaimer, the term of this patent is extended or adjusted under 35 U.S.C. 154(b) by 387 days.

(21) Appl. No.: 14/967,298

(22) Filed: Dec. 12, 2015

(65) Prior Publication Data

US 2017/0044807 A1 Feb. 16, 2017

Related U.S. Application Data

(60) Provisional application No. 62/204,389, filed on Aug. 12, 2015.

(51) Int. Cl.
*E05D 3/12* (2006.01)
*E05F 17/00* (2006.01)
(Continued)

(52) U.S. Cl.
CPC ..... *E05D 3/12* (2013.01); *A47B 95/00* (2013.01); *E05F 17/00* (2013.01); *A47B 96/16* (2013.01);
(Continued)

(58) Field of Classification Search
CPC .. E05D 3/06; E05D 3/12; E05D 3/122; E05D 3/142; E05D 3/183; E05F 1/10;
(Continued)

(56) References Cited

U.S. PATENT DOCUMENTS 1,768,173 A * 6/1930 Tucker ..... E05F 17/004 292/DIG. 12
1,899,171 A 2/1933 Warren
(Continued)

FOREIGN PATENT DOCUMENTS

DE 2132582 A1 * 2/1973 ..... E05F 17/002
DE 2731163 A1 * 1/1979 ..... E05F 17/002
(Continued)

OTHER PUBLICATIONS

Pre-manufactured toe kick plate bracket ezkick.net or adatoekick.com.

*Primary Examiner* — Joshua E Rodden

(57) ABSTRACT

The link assembly constitutes a mechanical connection between a cabinet door (108) and a toe kick plate (112) of the cabinet with both panels being hingedly attached to the same cabinet sidewall (114). The link assembly causes the toe kick plate (112) to move in synchronization with the movement of the door (108) and, when the cabinet door (108) is opened, the link causes the toe kick plate (112) to move into a position underneath the door (108). The link assembly pivots and self-adjusts dimensionally as required throughout the range of movement of the two hinged panels. The link assembly incorporates a resiliently biased over-center mechanism which urges the door (108) to remain in the open position until closed intentionally. The link assembly provides dual-axes adjustability for, and also supports the weight of, the toe kick plate free-swinging edge (112*a*).

10 Claims, 15 Drawing Sheets

(51) Int. Cl.

| | |
|---|---|
| ***A47B 96/00*** | (2006.01) |
| ***A47B 95/00*** | (2006.01) |
| *E05F 1/10* | (2006.01) |
| *A47B 96/16* | (2006.01) |

(52) U.S. Cl.
CPC ..... *A47B 2095/004* (2013.01); *E05F 1/10* (2013.01); *E05F 2017/008* (2013.01); *E05Y 2900/20* (2013.01)

(58) Field of Classification Search
CPC . E05F 1/12; E05F 17/00; E05F 17/002; E05F 17/004; E05F 2017/008; E05Y 2900/20; A47B 95/00; A47B 95/002; A47B 2094/004
USPC ..... 16/233, 365, 366, 368, 369; 312/278, 312/279
See application file for complete search history.

(56) References Cited

U.S. PATENT DOCUMENTS

| | | | | |
|---|---|---|---|---|
| 2,153,693 | A * | 4/1939 | Mitchell | E05F 17/004 49/103 |
| 2,206,051 | A * | 7/1940 | Roof | E05F 17/004 49/103 |
| 2,416,459 | A | 2/1947 | Slopa | |
| 2,598,814 | A * | 6/1952 | McAfee | E05F 17/004 312/275 |
| 2,775,342 | A | 12/1956 | Smith | |
| 3,724,921 | A | 4/1973 | Lake | |
| 3,997,265 | A | 1/1976 | Menon et al. | |
| 4,514,021 | A | 4/1985 | Sundermeier | |
| 4,639,051 | A | 1/1987 | DeBruyn | |
| 4,799,743 | A | 1/1989 | Kikuchi et al. | |
| 4,870,315 | A | 9/1989 | Neuhaus | |
| 5,303,508 | A | 4/1994 | Porte | |
| 5,370,452 | A | 12/1994 | Baer | |
| 5,664,852 | A | 9/1997 | Robinson | |
| 6,009,666 | A | 1/2000 | Nakamoto | |
| 6,415,477 | B1 * | 7/2002 | Hosaka | E05F 1/1261 16/284 |
| 6,835,022 | B2 | 1/2004 | Hightower | |
| 8,020,951 | B2 | 9/2011 | Twellman | |
| 8,226,180 | B2 * | 7/2012 | Patil | E05F 17/004 312/324 |
| 8,991,948 | B2 | 3/2015 | Marsters | |
| 2003/0159249 | A1 * | 8/2003 | Tsung-Lung | E05D 3/16 16/371 |
| 2005/0044664 | A1 * | 3/2005 | Chang | H04N 1/00543 16/327 |
| 2006/0113457 | A1 * | 6/2006 | Zhang | G03G 21/1666 248/637 |

FOREIGN PATENT DOCUMENTS

| | | | | |
|---|---|---|---|---|
| DE | 102011121864 | A1 * | 6/2013 | E05F 17/004 |
| FR | 2568929 | A1 * | 2/1986 | E05F 17/004 |
| WO | WO-2011043742 | A1 * | 4/2011 | E05C 7/02 |
| WO | WO-2014100892 | A9 | 8/2014 | |

* cited by examiner

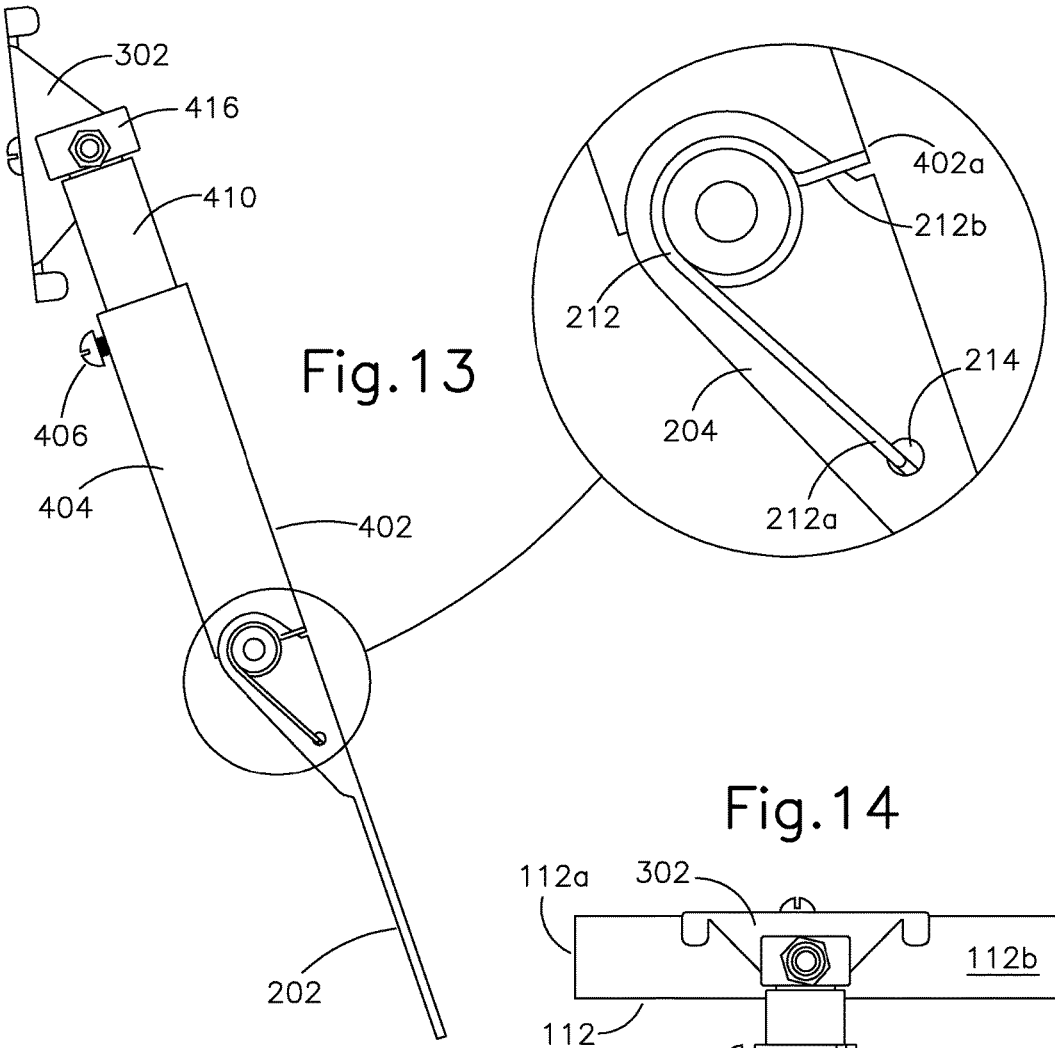
Fig.13
Fig.14
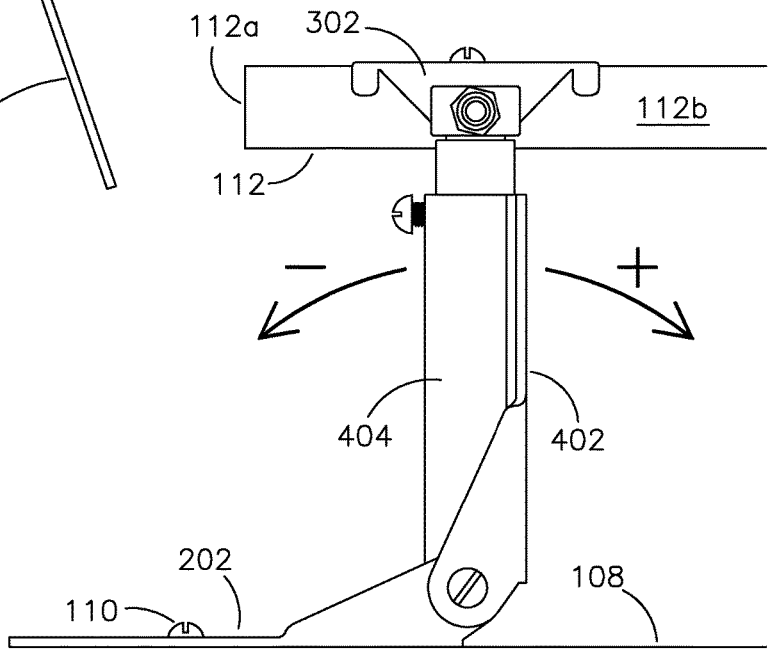

Fig.19
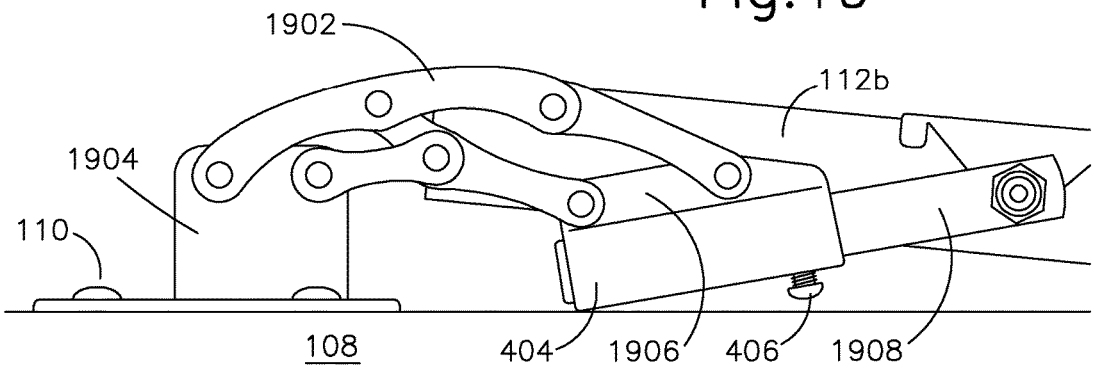
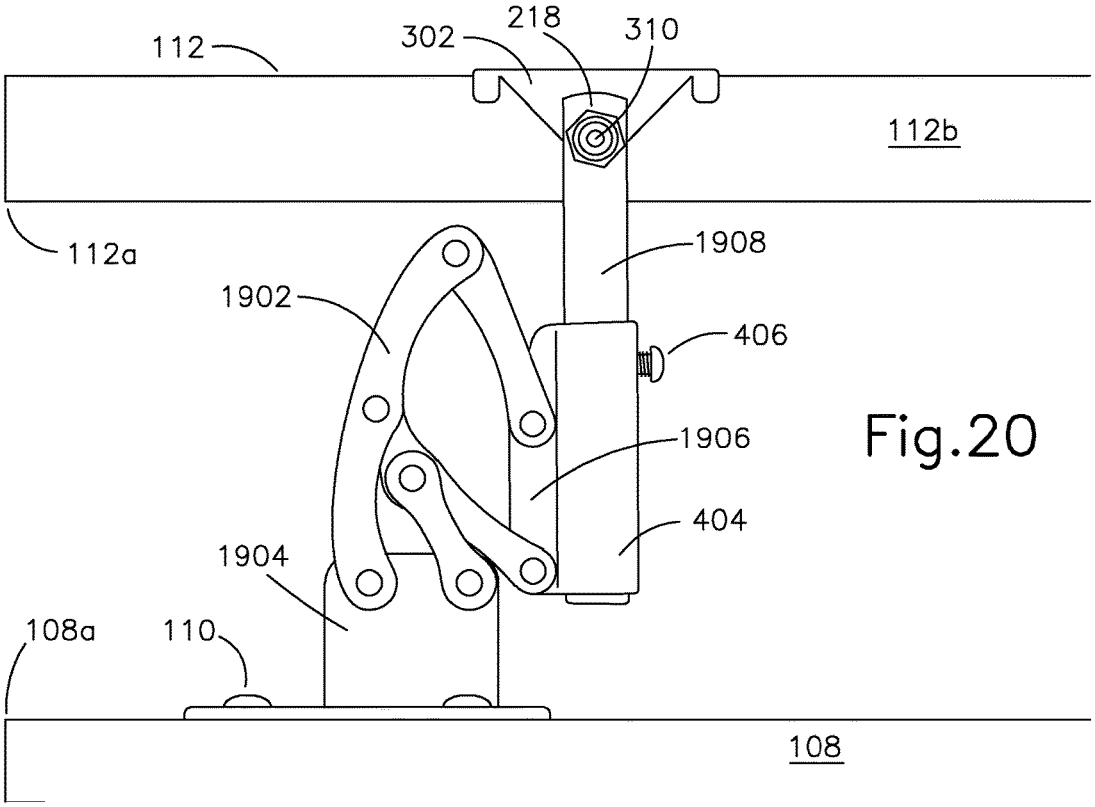
Fig.20

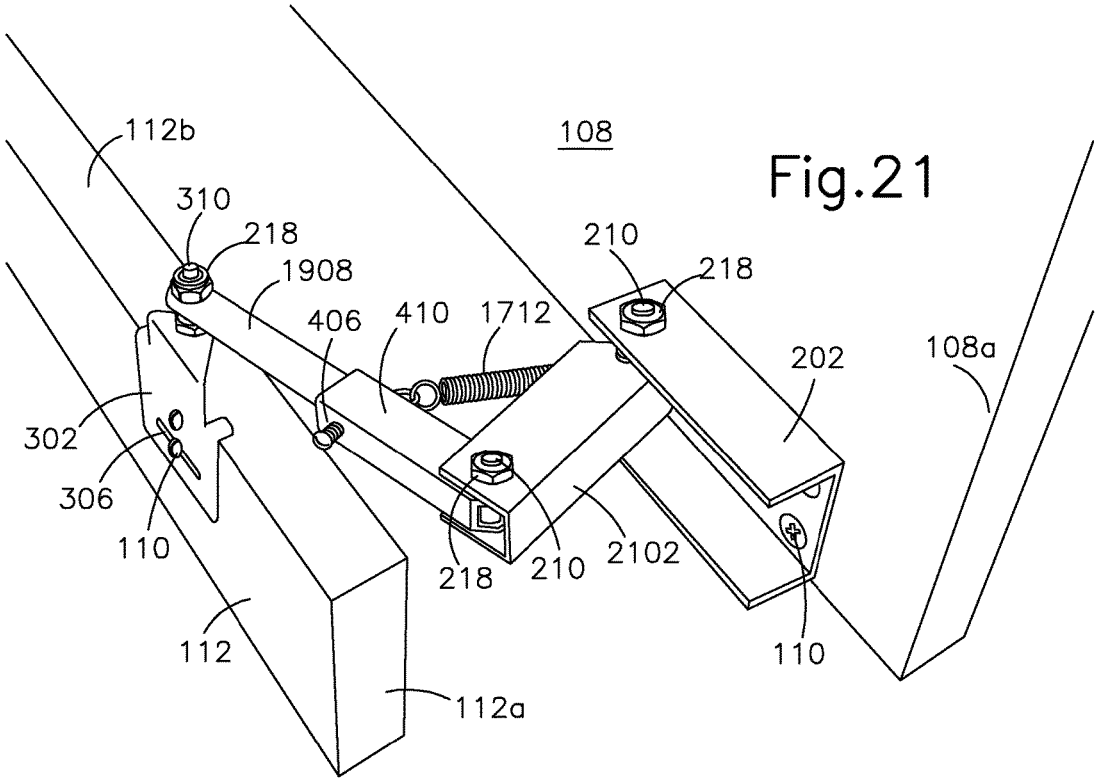
Fig.21
Fig.22
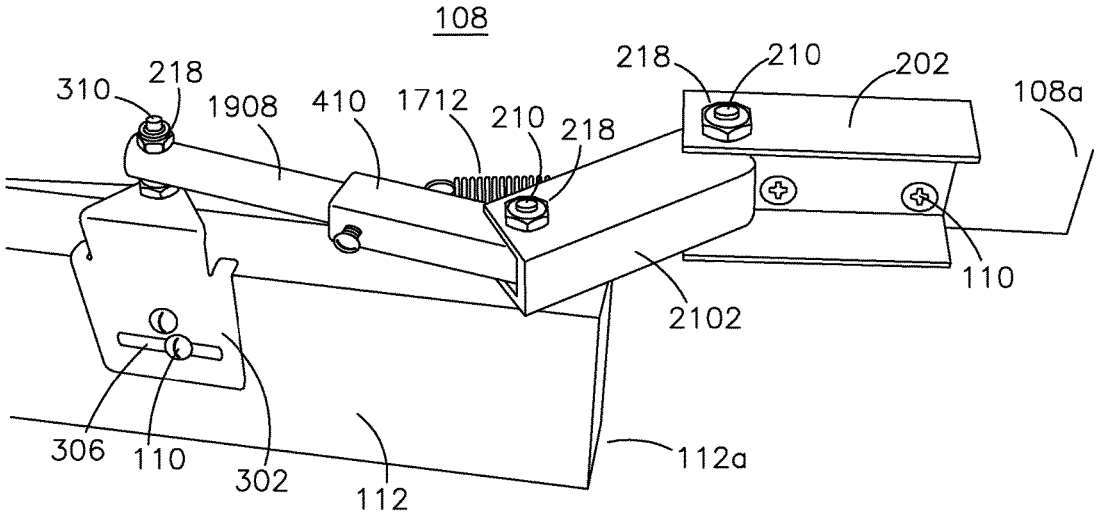

LINK ASSEMBLY FOR SYNCHRONIZING A CABINET TOE KICK PLATE WITH A DOOR OF THE CABINET

CROSS-REFERENCE TO RELATED APPLICATIONS

This application claims the benefit of U.S. provisional patent application No. 62/204,389, filed Aug. 12, 2015 by the present inventor.

BACKGROUND—PRIOR ART

Non-Patent Literature Documents

Pre-manufactured toe kick plate bracket from ezkick.net or adatoekick.com

In the simplest sense, a cabinet is a six-sided box constructed of durable materials having an opening on one of the six sides to allow access to the cavity within the box. A typical cabinet will also have at least one hinged door which lies flat against, and covers over, the opening in the cabinet. A "base cabinet" is a type of cabinet which would typically be found standing directly on, and supported by, a horizontal surface, such as the floor in a room, and will often have some manner of work-surface or other usable facility positioned above it.

Base cabinets typically have a floor panel fixed inside of them which is elevated several inches above the floor of the surrounding room. Whether used in a household or other type of commercial environment, base cabinets are commonly built with a recessed area called a "toe kick space" along the front, bottom portion thereof. The upper boundary of this space is formed by the forward, underside of the elevated cabinet floor and the vertical surface at the back of this space is faced with a panel called the "toe kick plate". The toe kick plate may be attached to the forward part of whatever supporting structure is under the cabinet or to the notched-back, lower portion of the cabinet sidewalls if the cabinet has been so constructed. A person's toes can enter this recessed space when they are facing the cabinet thereby permitting them to stand closer to the face of the cabinet and have more complete and more comfortable access to the countertop or other facilities positioned above the cabinet.

Some types of base cabinets do not have a floor panel attached inside of them. Instead, the actual horizontal surface upon which the cabinet stands, also serves as the floor within the cabinet. This type of base cabinet is called a "no-bottom" base cabinet and there are three reasons why a base cabinet may be constructed in this manner.

First, this makes it possible for a person in a wheelchair to have improved access to the area above the cabinet by being able to open the cabinet doors and drive the forward part of their wheelchair into the open space inside the cabinet.

Second, this allows for an article such as a trash bin, recycling bin, or some type of mechanical equipment to be concealed inside the cabinet behind closed doors.

And a third common reason for base cabinets to be built without a fixedly attached floor inside of them is to provide a space where a wheeled cart, such as a food-service cart, may be rolled in and neatly stowed behind the closed cabinet door.

I have found that significant problems arise when attempting to apply toe kick plates to no-bottom base cabinets due to their mutually exclusive nature. A toe kick plate, by definition, is meant to block the bottom, front portion of a base cabinet. But a no-bottom base cabinet, by definition, is meant to have unhindered access through the bottom, front part of it.

This problem is typically addressed in one of three ways:

First, the face of the cabinet may be extended down to the floor thus eliminating the toe kick space entirely along with the aesthetic and ergonomic benefits of having it there.

Second, the cabinet may be left without any toe kick plate at all. However, this will leave an open gap along the toe kick surface which will be unacceptable to many customers.

And finally, the third, and perhaps most commonly used solution, is to fixedly attach a toe kick plate to the backside of the cabinet door. In this case, the toe kick plate is held back in recess toward the interior of the cabinet, and below the cabinet door, by some manner of pre-manufactured or in-house-custom-made bracket.

This third solution may be the most commonly used solution but I have always found it to be costly to manufacture, poorly executed, and difficult to install when custom-made in-house. In addition, such brackets produce a cosmetically objectionable end-result, they are difficult to adjust, and are not readily adaptable to varying applications. But, of primary significance, a toe kick plate assembly protruding from the back of a cabinet door is an obstruction, an inconvenience and possibly even a hazard to the person using the cabinet. The hazardous nature of such being further magnified if the person using the cabinet is elderly or, in some way, struggles with mobility. Additionally, such a bracket-attached toe kick plate is in a position to be damaged by the user of the cabinet since it protrudes into the approach path to the cabinet interior cavity where it could be subjected to unintentional impacts or loads.

One pre-manufactured example of such a toe kick plate bracket is available at adatoekick.com and a .pdf sheet describing this bracket is included here as non-patent literature.

Another undesirable side-effect of these brackets is that they result in the end of the toe kick plate, which is furthest away from the hinge, to circumscribe an arc having a larger radius than the arc circumscribed by the free-swinging edge of the associated cabinet door. In many cases, "no-bottom" cabinets are of the size and type which require a matched pair of doors hinged to the opposing side-walls of the cabinet. The gap between the two meeting edges of the two doors is normally about one-eighth of an inch when the two doors are in the closed position. The circumscribed arcs of the free-swinging edges of the doors are nearest to each other at the point where the doors are in the closed position. The problem is that those ends of the rigidly attached toe kick plates, which are furthest from the cabinet door hinges, will circumscribe arcs that are even larger than the arcs circumscribed by the door edges because those ends of the toe kick plates are even further distant from the hinge axis of the door than are the free-swinging edges of the doors. This can result in the two ends of these toe kick plates striking each other or binding against each other if both cabinet doors are opened at the same time. This conflict can also prohibit one door from being opened singularly. In this case, even if the operator only wishes to open one of the two cabinet doors, the second door may have to be opened at least partially so that the toe kick plate of the first door can swing past the toe kick plate of the second door.

Toe kick plates can be specially fabricated with notched and back-mitered ends so that one door could be opened singularly without moving the second door. However, fabricating toe kick plates in this special fashion requires extra engineering and manufacturing time which equals a loss of profit for the manufacturer. And even still, this extra effort will not prevent the toe kick plates from binding against each other if both cabinet doors are opened simultaneously.

The toe kick plates could also be fabricated to be shorter so that they do not circumscribe arcs which are beyond the arcs circumscribed by the free-swinging edges of the doors. However, this practice also creates problems. If the toe kick plates are intentionally made short, as described, the result will be a gap between the two meeting edges of the toe kick plates when the doors are in the closed position. In some instances, this gap could be as wide as 3 inches.

To some extent, this may negate the purpose of having attached toe kicks in the first place if the purpose thereof was to leave the line of the cabinetry toe kick smooth, unbroken, clean and closed. In addition, if the toe kick plates are always being custom-made in this manner, it will consume additional engineering resources which is a hindrance to profitability.

Yet another problem associated with using a rigid bracket to attach a toe kick plate to the back of a cabinet door has to do with the adjustability of the toe kick plate. Many types of hinges used in contemporary cabinetry and furniture are highly adjustable. This supports the designing of cabinets and furniture with smaller tolerances in the gap distance between doors and drawer fronts. Having highly and easily adjustable hinges allows for each cabinet door to be easily adjusted into the exact correct position relative to the other cabinet doors or cabinet features juxtaposed to it. The problem here is the contradictory nature of pairing a highly adjustable cabinet door with a non- or only slightly-adjustable type of hardware, such as a rigid toe kick plate bracket, which has the effect of either limiting the adjustability of the hinge or causing the toe kick plate to be left out of alignment.

Yet still another problem associated with the bracket-attached toe kick plate stems from the demands placed on the cabinet and furniture industries to produce a variety of custom-made designs. This demand for adaptability, has become a standard which applies to all aspects of these industries even including those variables which uniquely affect the lowly toe kick plate. One such variable is "set-back" distance, that is, how far the face of the toe kick plate is set back behind the back of the cabinet door. Pre-manufactured toe kick plate brackets are typically only available in three inch and four inch set-back distances and in only a limited assortment of lengths.

Additional variables affecting toe kick plates are different types of hinges and hinge placement, and design considerations such as whether the toe kick plate will overlay the front edges of the cabinet side panels or if the toe kick plate will rest between the cabinet side panels. For the cleanest appearance across a row of adjoining base cabinets it would be preferable to have the toe kick plates of a "no-bottom" cabinet fabricated to overlay the fronts of the cabinet side panels. Typically, this would mean that the width of a toe kick plate would be the same as the width of the cabinet door it is attached to. In this scenario, the overall face of the toe kick line across a row of adjoining cabinets would only be broken by narrow vertical "reveal lines" on the left side, the right side, and in the center of a typical two-door, "no-bottom" cabinet. However, there are times when it may be desirable to have the toe kick plate run between the cabinet side panels or even, in some cases, having the toe kick plate overlay the front of the side panel on one side of the cabinet and not on the other side. One such case would be at the exposed and finished end of a row of cabinets where it may be desirable to have the end of the toe kick plate hidden behind the cabinet finished-end panel rather than having the end of the toe kick plate being co-planar with, and exposed at, the finished-end of the row of cabinets.

In conclusion, using rigid brackets to attach toe kick plates to cabinet doors can produce an inconvenient and/or hazardous obstruction in the approach path to cabinet interior cavity. Also, such brackets are often a hindrance to the basic operation of the cabinet doors and can be damaged easily. They produce an end-product with aesthetically objectionable attributes, as well as an end-product which has limited adjustability and adaptability. And finally, these brackets are a drag on a manufacturer's profitability when custom-made in-house. My link assembly for synchronizing a cabinet toe kick plate with a door of the cabinet solves all of these problems and provides additional benefits as well.

ADVANTAGES

Accordingly several advantages of one or more aspects are as follows: moving an attached toe kick plate of a no-bottom base cabinet into a position where it will not protrude into the approach-path to the interior of the cabinet once the cabinet door is opened, incorporating a toe kick plate on the cabinet which consumes less manufacturing engineering and production resources than prior art toe kick plates, allowing that the doors of the base cabinet may be opened singularly or concurrently without the toe kick plates interfering with each other, providing a range of adjustability to the toe kick plate which meets or exceeds the capabilities of any other hardware likely to be used in conjunction with it, providing a resiliently biased behavior urging the doors to remain open until closed intentionally, being equally usable on systems of left-hand hinged panels or right-hand hinged panels, and being designed to sustain accidental loads without a loss of function. Other advantages of one or more aspects will be apparent from a consideration of the drawings and ensuing description.

SUMMARY

In accordance with one embodiment, my link assembly constitutes a mechanical connection between the door of a cabinet and the toe kick plate of the cabinet with the toe kick plate being hingedly attached to the same cabinet sidewall whereupon is also hingedly attached the door to which the toe kick plate shall be linked. My link assembly causes the toe kick plate to move synchronously with the cabinet door when the door is moved. Additionally, when the cabinet door is opened, my link assembly causes the toe kick plate to move toward a position underneath the door. My link assembly pivots and self-adjusts dimensionally as required throughout the range of movement of the two hinged panels and, in addition, provides a resiliently biased, over-center mechanism to hold the door in the fully opened position. My link assembly can be equally applied to systems of left-hand hinged panels or right-hand hinged panels.

DRAWINGS—FIGURES

FIG. 13 is a detail showing a torsion spring of my link assembly.

FIG. 14 is a top view of my link assembly defining negative and positive deflection.

FIG. 19 is a top view drawing of one alternate embodiment of my link assembly.

FIG. 20 is a top view drawing of one alternate embodiment of my link assembly.

FIG. 21 is a perspective drawing of one alternate embodiment of my link assembly.

FIG. 22 is a perspective drawing of one alternate embodiment of my link assembly.

GLOSSARY

When the opening of a cabinet door is referred to by a matter of "degrees" this is in reference to the angular deflection of the door away from the fully closed position. For example, if the door is said to be 90 degrees open, that would mean it has been rotated through 90 degrees around its hinge axis away from the fully closed position.

Those edges of the door and toe kick plate which are parallel to, and furthest from, the hinged edges are the "free-swinging" edges of these panels.

DETAILED DESCRIPTION—FIRST EMBODIMENT—FIGS. 1-6

Figure 1:
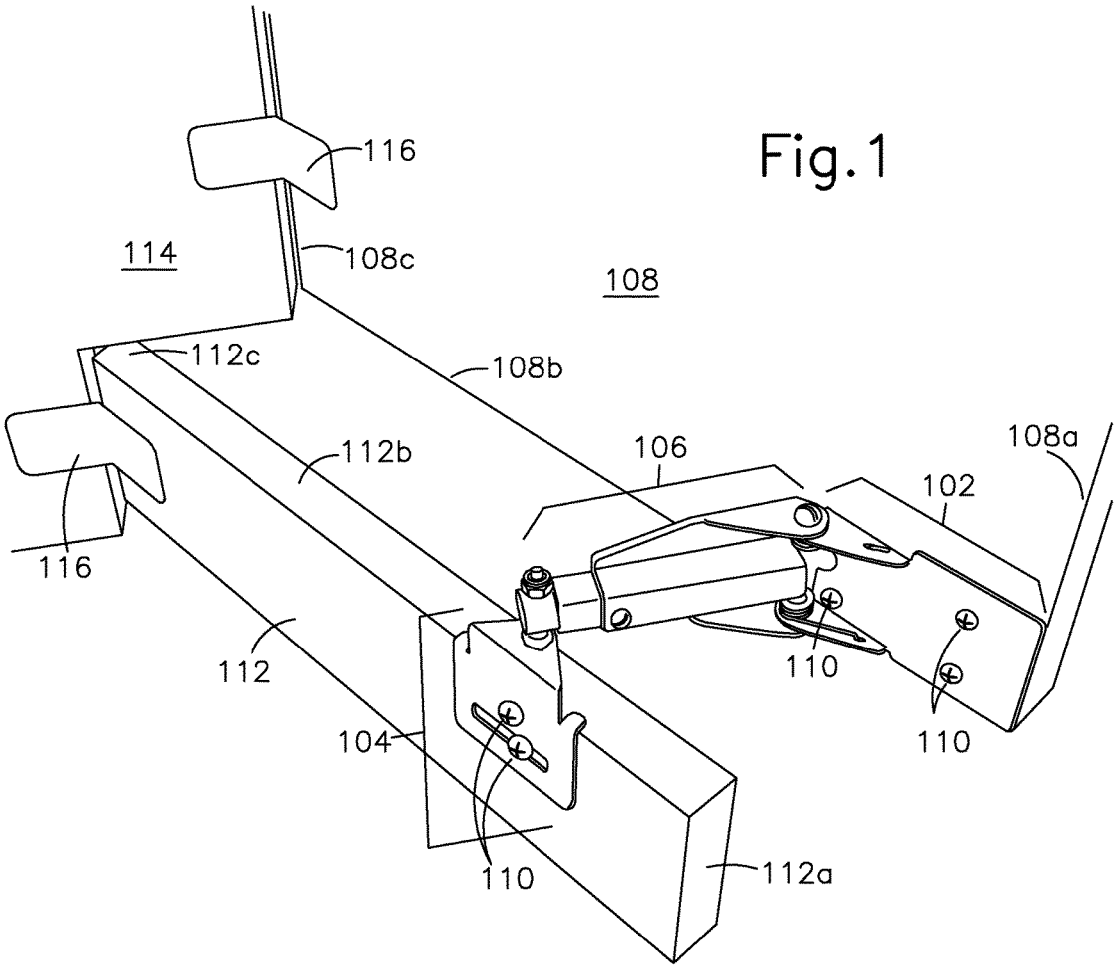
FIG. 1 is a perspective drawing of my link assembly in a typical installation.

FIG. 1 is a perspective view identifying the three primary sub-assemblies of the first embodiment of my link assembly as well as the associated cabinet parts in a typical installation. The three sub-assemblies are the base assembly 102, the toe kick plate bracket assembly 104, and the bridge assembly 106. Except as noted otherwise below, the main portion of each of the three primary sub-assemblies is formed from 16 gauge sheet-metal but could also be fabricated from a material selected from the group of materials consisting of a different gauge of sheet-metal, a laminated multi-ply natural, synthetic, or composite material, an extruded natural, synthetic, or composite material, milled from a natural, synthetic, or composite solid stock, or a mold-formed natural, synthetic, or composite material.

The base assembly 102 is fixedly attached to the back of the cabinet door 108 at the intersection of the door free-swinging edge 108*a* and the door bottom edge 108*b*. The toe kick plate bracket assembly 104 is adjustably attached to the toe kick plate 112 adjacent to the toe kick plate free-swinging edge 112*a* and contacts both the back of the toe kick plate 112 and the toe kick plate top edge 112*b*. The bridge assembly 106 is pivotally attached by one of its ends to the base assembly 102 and, also pivotally attached by the other of its ends, to the toe kick plate bracket assembly 104. And finally, the installation of my link assembly is complete when the door hinge edge 108*c* and the toe kick plate hinge edge 112*c* are hingedly attached to the same cabinet sidewall 114 by means of a suitable type of cabinetry hinge 116.

FIG. 1 shows my link assembly as applied to a right-hand-hinged door 108, and toe kick plate 112. However, my link assembly may be equally applied to a pairs of left-hand hinged panels as well as pairs of hinged panels which are oriented in virtually any direction with respect to the force-vector of Earth's gravity.

Figure 2:
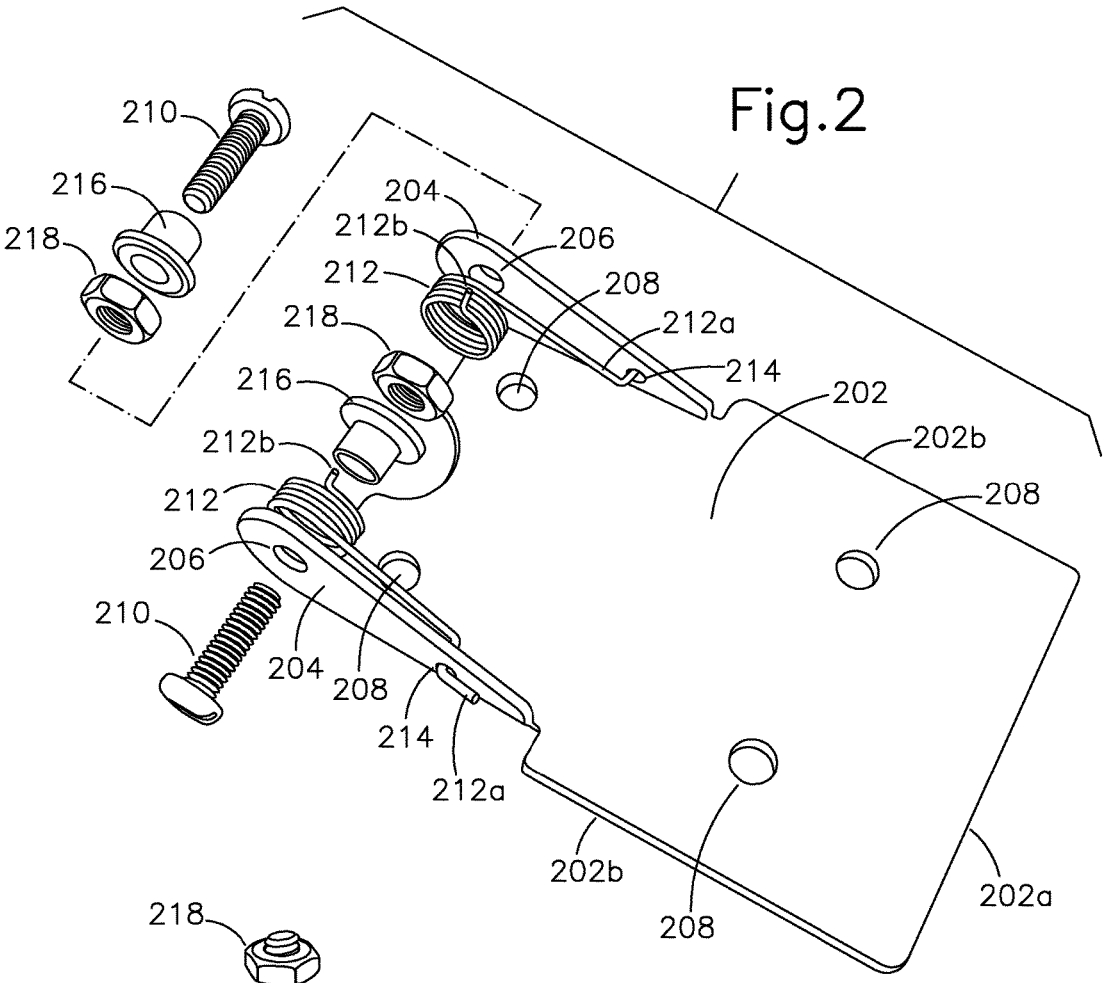
FIG. 2 is an exploded perspective drawing of a sub-assembly of my link assembly.

FIG. 2 is an exploded perspective view of the base assembly 102 which is the first of the three main sub-assemblies of my link assembly. The main portion of the base assembly 102 is the base segment 202 which is flat on one face and generally rectangular in shape having a width roughly half the length and having plural pivot bosses 204 along one of the short edges. The base segment 202 is positioned on the back of a cabinet door 108 with the vertical alignment edge 202*a* flush to the door free-swinging edge 108*a* and with a horizontal alignment edge 202*b* flush to the door bottom edge 108*b*. The base segment 202 is positioned with its flat face against the back surface of the door 108 with pivot bosses 204, having pivot pin apertures 206, projecting rearward from the back of the door 108. The base segment 202 is fixedly attached to the door 108 by driving an appropriate screw fastener 110 into the door 108 through each of the affixing apertures 208 in the base segment 202. The means of fixedly attaching the base segment 202 to the back of the door 108 may also be selected from the group consisting of bolts and nuts, rivets, adhesives, and welds.

Figure 3:
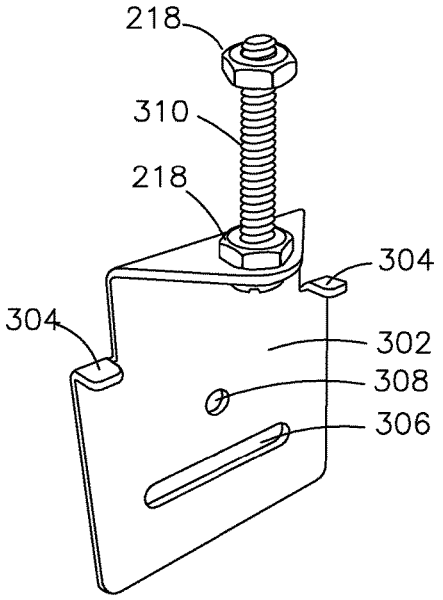
FIG. 3 is a perspective drawing of a sub-assembly of my link assembly.

FIG. 3 is a perspective view of the toe kick plate bracket assembly 104 which is the second sub-assembly of my link assembly. The main portion of the toe kick plate bracket assembly 104 is the toe kick plate bracket 302 which has integral positioning flanges or ears 304 which are used to align the toe kick plate bracket 302 to the intersection of the back and top edge 112*b* of the toe kick plate 112. The toe kick plate bracket 302 is initially attached slidably to the toe kick plate 112, adjacent to the toe kick plate free-swinging edge 112*a*, by driving an appropriate screw fastener 110 into the toe kick plate through a slotted penetration 306 in the toe kick plate bracket 302. This allows for lateral adjustment of the toe kick plate bracket 302 on the toe kick plate 112 for the purpose of fine-tuning the function of my link assembly. After the position of the toe kick plate bracket 302 has been adjusted, it is then fixedly attached to the toe kick plate 112 by driving an additional screw fastener 110 into the toe kick plate 112 through a final set-hole 308 in the toe kick plate bracket 302. The means of attaching the toe kick plate bracket 302 to the back of the door 108 may also be selected from the group consisting of bolts and nuts, rivets, adhesives, and welds.

Fixedly attached to the top of the toe kick plate bracket 302 and pointing upwards away from the top of the toe kick plate bracket 302 is a threaded machine screw which is called the toe kick plate bracket pivot pin 310.

Figure 4:
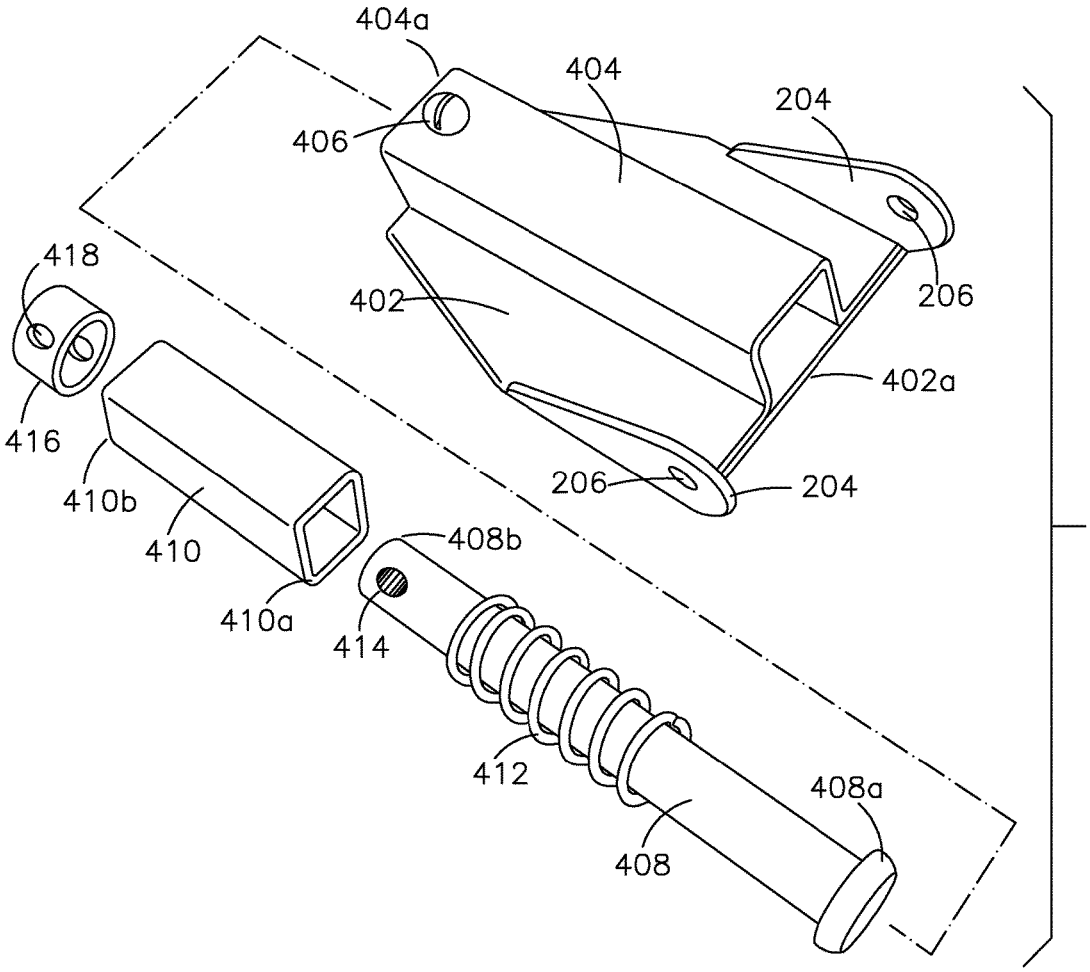
FIG. 4 is an exploded perspective drawing of a sub-assembly of my link assembly.

FIG. 4 is an exploded perspective view of the bridge assembly 106 which is the third sub-assembly of my link assembly. The main portion of the bridge assembly 106 is the bridge segment 402 which, in the first embodiment, is roughly the shape of an isosceles triangle having the two equal sides being longer than the third side. This third side, the bridge segment pivot boss edge 402*a*, has plural pivot bosses 204 with pivot pin apertures 206 which are similar to, and designed to align and mesh with, the pivot bosses 204 and pivot pin apertures 206 on the base segment 202. The bridge segment 402 is formed with an integral elongated cavity upon it referred to as the bridge barrel 404. The bridge barrel 404 may also be a separate section of tubing fixedly attached to the bridge segment 402. Such a tubing might be composed of a material selected from the same group of alternate materials presented previously with respect to the base segment 202. The central axis of the bridge barrel 404 runs perpendicularly away from the mid-point of the bridge segment pivot boss edge 402*a*. The end of the bridge barrel 404 furthest from the bridge segment pivot boss edge 402*a* is the mouth-end 404*a* of the bridge barrel 404. Near this end, is a penetration which has been drilled laterally through the sidewall of the bridge barrel 404. This penetration is threaded to receive the barrel set screw 406.

Additional parts of bridge assembly 106 which will be slidably inserted into the bridge barrel 404 are a metal pin, called the bridge pin 408, a metal tube, called the bridge tube 410, and a compression spring 412. The bridge pin 408 has an enlarged flange at one end much like a head on a nail and is called the head 408*a* on the bridge pin 408. The outside dimension of the head 408*a* is less than the inside dimension of the bridge barrel 404 allowing the head 408*a* to move slidably within the bridge barrel 404 with minimal lateral play. Near the end of the bridge pin 408 opposite from the head 408*a* is at least one hole drilled laterally and fully through the bridge pin 408. This hole is the eye 414 in the bridge pin 408 and that end of the bridge pin 408 where the eye 414 is located is the eye-end 408*b* of the bridge pin 408. The eye 414 is of an appropriate size to allow the toe kick plate bracket pivot pin 310 to fit through it with minimal lateral play. In one variation, the bridge pin 408 may be longer and have more than one eye 414 allowing the bridge assembly 106 to span a wider range of set-back distances between the cabinet door 108 and the toe kick plate 112.

The outside dimensions of the bridge tube 410 are less than the inside dimensions of the bridge barrel 404 allowing the bridge tube 410 to move slidably within the bridge barrel 404 with minimal lateral play. Although the bridge tube 410 is technically equal at both ends, for the purposes of description, one end is the entry-end 410*a* and the opposite end is the exit-end 410*b*. The inside dimensions of the bridge tube 410 are greater than the outside dimension of the shaft of the bridge pin 408 allowing the shaft to move slidably within the bridge tube 410 with minimal lateral play. In the first embodiment of my link assembly, the bridge tube 410 has a square cross-section and is made of steel but, as with the bridge barrel 404, other cross-sectional shapes and other materials, may provide good results also.

The inside diameter of the compression spring 412 is greater than the outside diameter of the shaft of the bridge pin 408 and less than the outside diameter of the bridge pin head 408*a*. The compression spring 412 is free to expand and contract with the bridge pin 408 slidably inserted through it and yet not able to escape over the outside diameter of the head 408*a*. The outside diameter of the compression spring 412 is smaller than the inside diameter of the bridge barrel 404 so that the compression spring 412 will function while inside the bridge barrel 404 without dragging or binding against the inside surfaces of the bridge barrel 404.

The lengthwise dimensions of the bridge pin 408, bridge tube 410, and compression spring 412 are derived from the amount of available compressibility of the compression spring 412, the distance between the cabinet door 108 and toe kick plate 112, and the amount of dimensional self-adjustability that is required from the bridge assembly 106. The length and rate of the compression spring 412 are derived from experimentation to determine the optimum specifications required for optimum performance of my link assembly.

The bridge pin 408 is inserted eye-end 408*b* first, through the compression spring 412 and then into the entry-end 410*a* of the bridge tube 410. Then, this sub-assembly consisting of bridge pin 408, bridge tube 410 and compression spring 412 is inserted bridge pin head 408*a* first into the mouth-end 404*a* of the bridge barrel 404 on the bridge segment 402 and held in place by tightening the barrel set-screw 406 against the bridge tube 410.

Finally, to complete the bridge assembly 106, a bumper 416 is positioned on the eye-end 408*b* of the bridge pin 408. The bumper 416 is of a hollow cylindrical shape and made of a resilient material such as rubber, or a soft plastic, or a semi-hard plastic. The inside diameter of the bumper 416 is substantially equal to the outside diameter of the bridge pin 408 and the wall thickness is roughly one-sixth the inside diameter but may vary according to various embodiments. The length of the bumper 416 is roughly equal to the outside diameter of the bumper 416 yet may vary according to different embodiments. The bumper 416 has an additional minor penetration 418 laterally through it. The centerline of this minor penetration 418 passes perpendicularly through the mid-point of the major axis of the bumper 416. The inside diameter of this minor penetration 418 is of a size to accept the toe kick bracket pivot pin 310. The bumper 416 is fitted onto the eye-end 408*b* of the bridge pin 408 with the minor penetration 418 aligned with the eye 414. The bumper 416 is so situated as to be a buffer where the exit-end 410*b* of the bridge tube 410 would otherwise strike the toe kick bracket pivot pin 310. The bumper 416 may also act as a buffer at a point where the bridge pin eye-end 408*b* might strike the back of the cabinet door 108.

Figure 11:
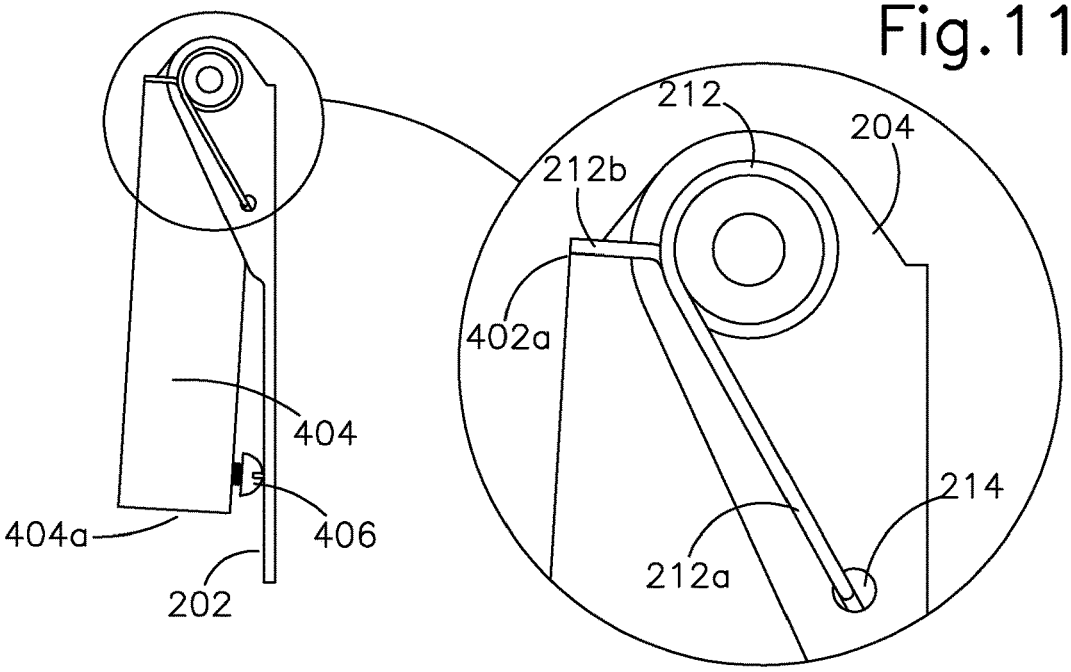
FIG. 11 is a detail showing a torsion spring of my link assembly.

The base segment 202 and bridge segment 402 are pivotally connected with two axially aligned pivot pins 210, inserted through the aligned pivot pin apertures 206 of the intermeshed pivot bosses 204 of these two segments. Situated concentrically around each of these two pivot pins 210 are a pair of coiled torsion springs 212 which are mirror images of each other, one right-hand wound and one left-hand wound. Each torsion spring 212 has one long arm 212*a* and one short arm 212*b* extending from the coil 90 radial degrees apart from each other. The long arm 212*a* has a double offset bend allowing it to be insertably attached to the base segment through a torsion spring mounting aperture 214 prepared therein for it. The short arm 212*b* of each torsion spring 212 applies direct pressure against the bridge segment pivot boss edge 402*a* thus urging the bridge segment 402 and base segment 202 to lay flat over each other as shown in FIG. 11. Holding the torsion springs 212 in concentric position around the pivot pins 210 are a two flanged shoulder washers 216 which, in turn, are retained on the pivot pins 210 with self-locking hex nuts 218. Non-threaded rivets or other types of smooth pins or rods could also be used successfully as pivot pins 210 instead of the threaded machine screws described. A continuous pivot pin could be used reaching from the outside of one bridge segment pivot boss 204 to the outside of the opposite bridge segment pivot boss 204 if such a pin would not be in conflict with any other moveable parts.

Figure 5:
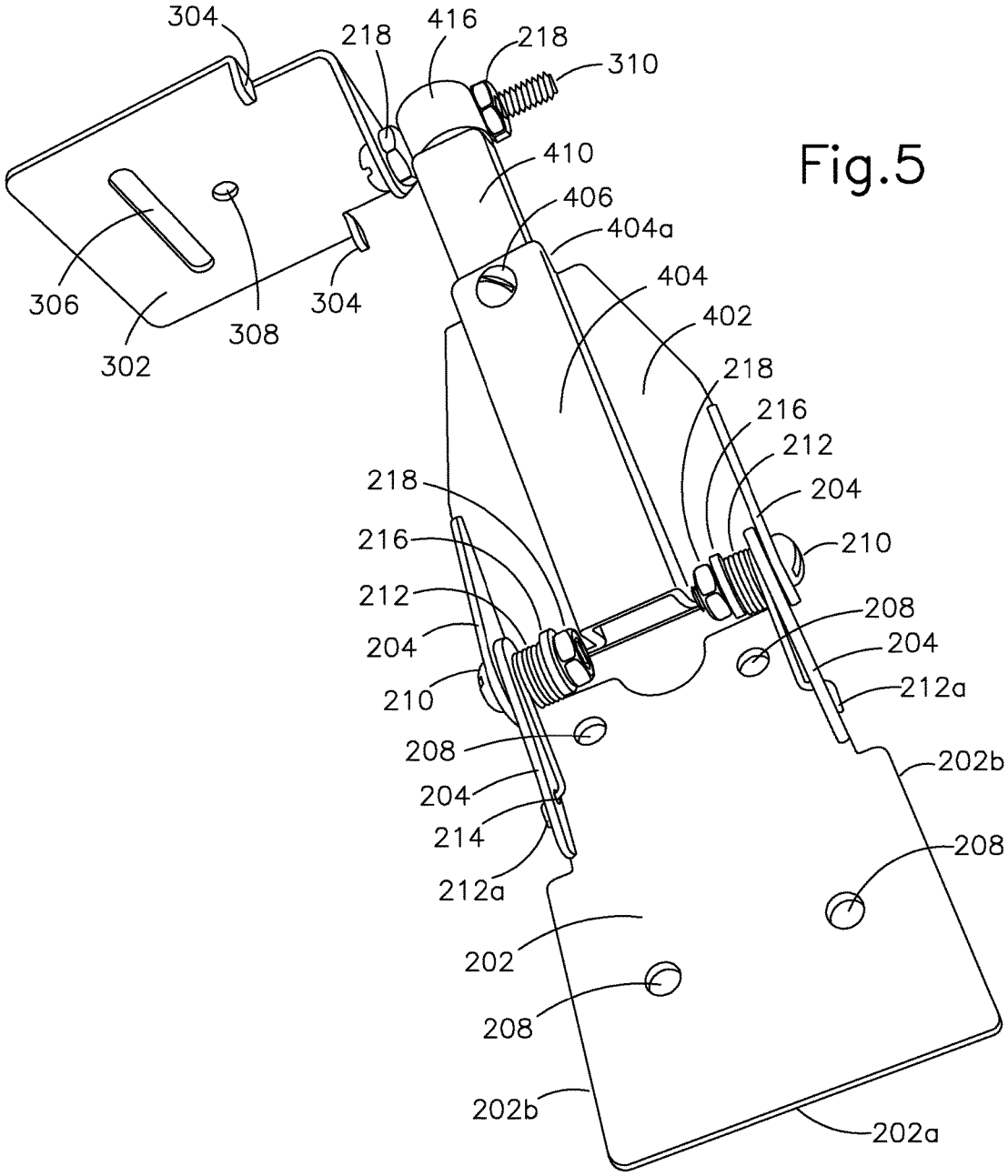
FIG. 5 is a perspective drawing of my entire link assembly.

FIG. 5 is a perspective view of my link assembly which has been completed by pivotally connecting the bridge assembly 106 to the toe kick plate bracket assembly 104. The toe kick plate bracket pivot pin 310 is inserted through both the minor penetration 418 in the bumper 416 and the bridge pin eye 414 and retained by a self-locking hex nut 218 which is screwed onto the toe kick plate bracket pivot pin 310. In one variation, an additional hex nut 218 may be placed on the toe kick plate bracket pivot pin 310 below the bridge pin 408 to act as a positive stop for retaining the location of the bridge pin 408 longitudinally on the toe kick plate bracket pivot pin 310. This additional hex nut 218 would be particularly important if the entire link assembly is used in an inverted condition in an alternate ramification.

Figure 6:
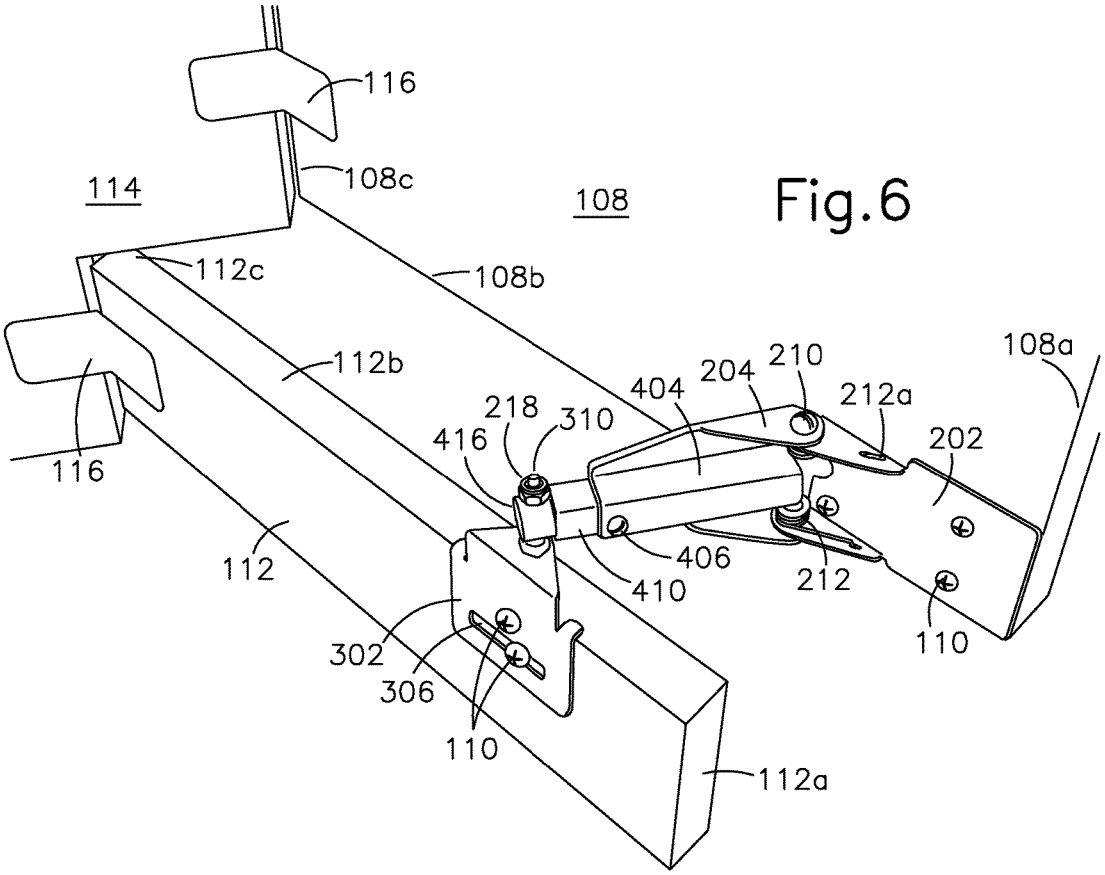
FIG. 6 is a perspective drawing of my link assembly in a typical installation.

FIG. 6 is a perspective view of a typical completed installation of my link assembly forming a mechanical link between a cabinet door 108 and toe kick plate 112. The toe kick plate hinge edge 112*c* and cabinet door hinge edge 108*c* are both hingedly attached to the same cabinet sidewall 114 by means of any suitable type of cabinetry hinge 116. The height of the toe kick plate free-swinging edge 112*a* can be adjusted relative to the cabinet door 108 by changing how far the self-locking hex nut 218 is threaded down onto the toe kick plate bracket pivot pin 310.

Drawings—Reference Numerals

Reference numbers are three digits with the first digit representing the earliest figure number wherein the part is first numbered. Some reference numbers are four digits with the first two digits representing the earliest figure number wherein the part is first numbered.

Operation—FIGS. 6-13

Figure 7:
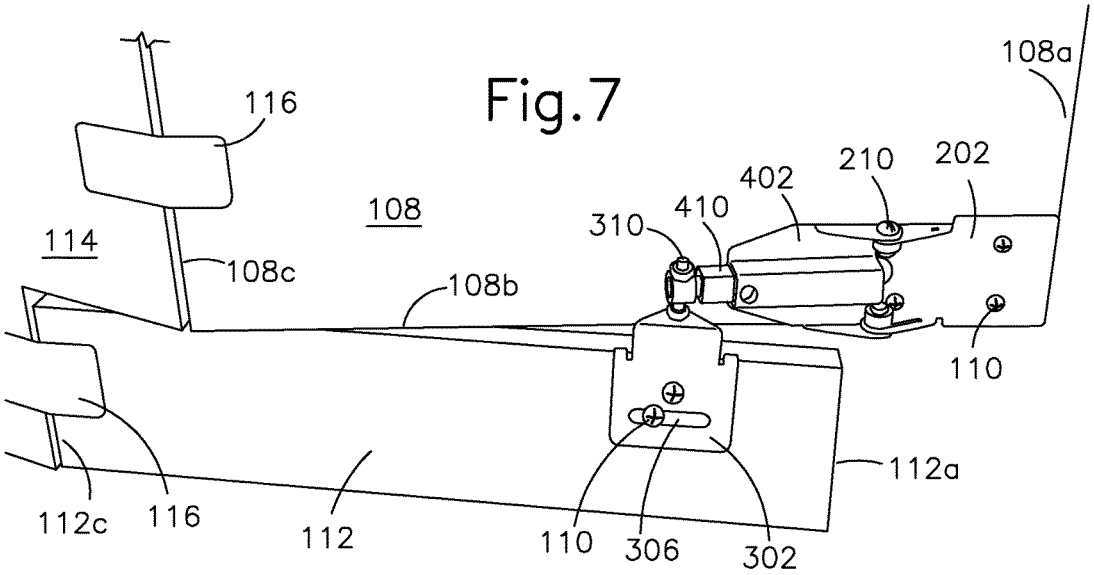
FIG. 7 is a perspective drawing of my link assembly in a typical installation.

FIGS. 6 and 7—As a result of my link assembly forming a mechanical connection between the door 108 and toe kick plate 112, when the door 108 is opened, the toe kick plate 112 follows in the same direction. When the door 108 is roughly 80 degrees open, the mid-section of toe kick plate 112 begins to pass underneath the door hinge edge 108*c*. As the door 108 is further swung toward 90 degrees open, both the bridge assembly 106 and the toe kick plate 112 are moving toward an orientation approximately coplanar with the door 108. When the door 108 is approximately 120 degrees open, FIG. 7, the toe kick plate 112 reaches a point of minimum reveal where only the smallest portion of the toe kick plate 112 protrudes rearwards of the plane described by the back side of the door 108.

The pivotal attachment points of the bridge assembly 106 are, on one end, at the center-point of the pivot pins 210 and, on the other end, at the center-point of the eye 414 on the bridge pin 408. The resting length of the bridge assembly 106 is defined by the distance between these two pivotal attachment points when there is no mechanical tension acting to draw these points away from each other. As the door 108 and toe kick plate 112 are swung about their distinctly separate axes, the two pivotal attachment points of the bridge assembly 106 circumscribe non-concentric arcs which results in the angular orientation and distance between these two points changing continuously throughout the range of movement of the two panels. The bridge assembly 106 is designed to concurrently pivot and also self-adjust dimensionally as these non-concentric arcs diverge or converge. As observed in a typical application of my link assembly, the bridge assembly 106 will begin to increase in length as the door 108 is opened beyond approximately 50 degrees as a result of the circumscribed arcs of the bridge assembly 106 pivot points diverging. After reaching a point of maximum eccentricity, when the door is roughly

| | |
|---|---|
| 102 base assembly | 104 toe kick plate bracket assembly |
| 106 bridge assembly | 108 door |
| 108a door free-swinging edge | 108b bottom edge |
| 108c door hinge edge | 110 screw fastener |
| 112 toe kick plate | 112a toe kick plate free-swinging edge |
| 112b top edge | 112c toe kick plate hinge edge |
| 114 cabinet sidewall | 116 hinge |
| 202 base segment | 202a vertical alignment edge |
| 202b horizontal alignment edge | 204 pivot boss |
| 206 pivot pin aperture | 208 base segment affixing aperture |
| 210 pivot pins | 212 torsion spring |
| 212a long arm | 212b short arm |
| 214 torsion spring mounting aperture | 216 flanged shoulder washer |
| 218 self-locking hex nut | 302 toe kick plate bracket |
| 304 alignment ear | 306 slotted penetration |
| 308 final set-hole | 310 toe kick plate bracket pivot pin |
| 402 bridge segment | 402a bridge segment pivot boss edge |
| 404 bridge barrel | 404a mouth-end |
| 406 barrel set screw | 408 bridge pin |
| 408a head | 408b eye-end |
| 410 bridge tube | 410a entry-end |
| 410b exit-end | 412 compression spring |
| 414 eye | 416 bumper |
| 418 minor penetration | 1602 block |
| 1604 block pivot pin | 1606 c-channel |
| 1702 mounting bracket | 1704 truss-head machine screw |
| 1706 slide bar | 1708 mounting boss |
| 1710 attachment post | 1712 extension spring |
| 1902 pantograph device | 1904 dual pivot mounting bracket |
| 1906 dual pivot flange | 1908 modified bridge pin |
| 2102 modified bridge segment | |

90 degrees opened, these circumscribed arcs begin to converge and the bridge assembly 106 resiliently contracts toward its original length.

Figure 8:
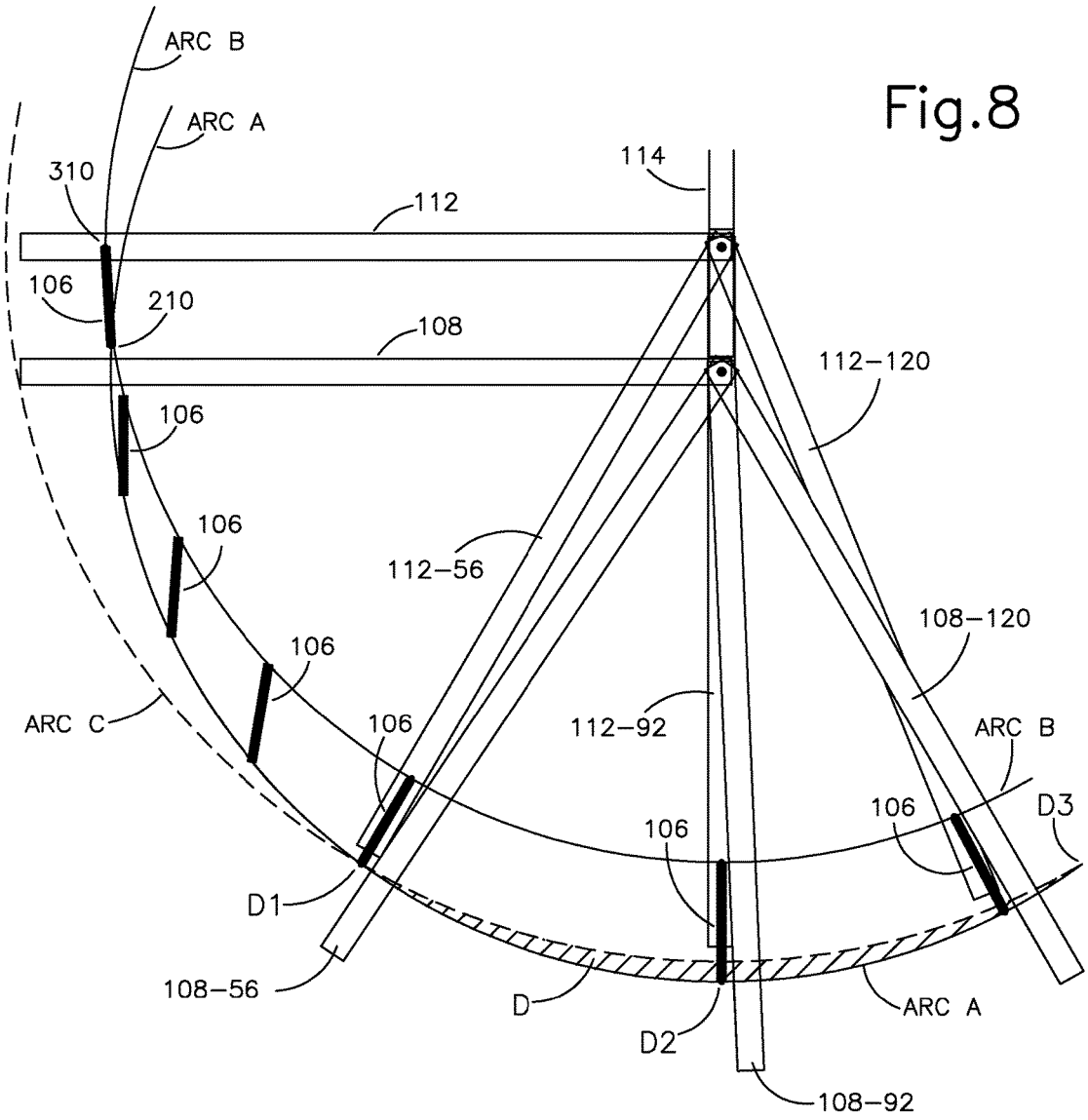
FIG. 8 is a diagram demonstrating the over-center biasing behavior of my link assembly.

FIG. 8 is a diagram which shows, in one typical application of my link assembly, what happens to the bridge assembly 106 at different points when the linked door 108 and toe kick plate 112 are swung open. The dark heavy lines represent the bridge assembly 106 in various positions having one end pivotally attached to the cabinet door 108 with pivot pins 210 and its other end pivotally attached to the toe kick plate 112 with the toe kick plate bracket pivot pin 310. As the cabinet door 108 is swung open, the centerline of the pivot pins 210 circumscribe ARC A. Concurrently, the centerline of the toe kick plate bracket pivot pin 310 circumscribes ARC B. The radius of the dashed arc, ARC C, is the sum of the radius of ARC B plus the resting length of the bridge assembly 106. The door 108 and toe kick plate 112 positions marked 112-56 and 108-56 represent the door having been opened to 56 degrees.

FIG. 8 demonstrates that, at point D1, ARC A crosses to the outside of ARC C and begins to diverge beyond ARC C until reaching a point of maximum divergence at point D2. Beyond point D2, ARC A converges back toward ARC C and crosses ARC C at point D3. The thin, cross-hatched, crescent area, marked D, between points D1 and D3, represents the range where tension on the bridge assembly 106 causes the bridge pin 408 to be drawn out of the bridge barrel 404 concurrently compressing the compression spring 412. The door 108 and toe kick plate 112 positions marked 108-92 and 112-92 represent the door having been opened to 92 degrees. At this point, where the crescent D is at its widest, the compression spring 412 within the bridge barrel 404 reaches its point of maximum compression.

Interestingly, the width across the widest point of crescent D cannot exceed the maximum compressibility of the compression spring 412. If it does, the compression spring 412 will reach maximum compression before the door 108 swings past that point and the "bottomed-out" compression spring 412 will prohibit the door 108 from being opened any further. If this condition occurs, it is corrected by increasing the resting length of the bridge assembly 106 by adjusting the bridge tube 410 further out of the bridge barrel 404. This action effectively increases the radius of ARC C and narrows the width of crescent D. Increasing the resting length of the bridge assembly 106 will also push the toe kick plate free-swinging edge 112*a* out of its correctly adjusted position when the cabinet door 108 is closed. This is re-adjusted by moving the toe kick plate bracket nearer to the toe kick plate free-swinging edge 112*a*.

It should be noted that it is possible for the toe kick plate bracket 302 and bridge tube 410 to be precisely adjusted to such a point that causes in the widest point of crescent D in FIG. 8 to become zero. In this instance, the door can be opened without the compression spring 412 being compressed. In this instance, the dimensional self-adjustability of the bridge segment 402 is not required. However, as discussed later in the Alternate Embodiments section, when my link assembly does not possess this dimensional self-adjustability, it is very difficult to get both the bridge tube 410 and toe kick plate bracket 302 precisely adjusted to the exact correct positions that would result in my link assembly functioning properly.

The compression spring 412 within the bridge barrel 404 serves two distinct purposes. Primarily, it urges the bridge assembly 106 to retract to its original length when tension forces across the bridge assembly 106 are reduced. As previously described, when the door 108 is opened beyond point D1 of FIG. 8, there is a resultant increasing tension across of the bridge assembly 106 as the circumscribed arcs of my link assembly attachment points diverge. Consequently, due to this increasing tension, the bridge assembly 106 increases in length as the bridge pin 408 is drawn through the bridge tube 410 simultaneously exposing more of the eye-end 408*b* of the bridge pin 408 and compressing the compression spring 412 between the head 408*a* of bridge pin 408 and the entry-end 410*a* of the bridge tube 410. When the tension on the bridge assembly 106 is reduced, such as when the cabinet door is being returned to the closed position, the stored energy within the compression spring 412 pushes the head 408*a* of the bridge pin 408 away from the entry-end 410*a* of the bridge tube 410 thus causing the bridge assembly 106 to contract toward its original length.

The secondary purpose of the compression spring 412 within the bridge barrel 404 is in causing the bridge assembly 106 to behave as an over-center biasing mechanism which produces two desirable effects. First, this mechanism urges the door 108 to remain beyond point D2 of FIG. 8 and thus mitigate unintended closing of the door 108. And secondly, this mechanism urges the door toward the closed position when the door is not open as far as point D2 of FIG. 8. As previously described, concurrent with opening the door 108 beyond point D1 of FIG. 8, the compression spring 412 becomes increasingly compressed due to the tension being placed on the bridge assembly 106. Again, as previously described, when tension on the bridge assembly 106 is reduced, it is urged by the stored energy within the compression spring 412 to contract to its original length. This resilient contraction occurs not only when the door 108 is being closed but also as the door 108 is opened beyond point D2 of FIG. 8. Beyond this point, the circumscribed arcs of the bridge assembly 106 attachment points also begin to converge resulting in a lessening of the tension on the bridge assembly 106. Consequently, the stored energy within the compression spring 412 urges the door 108 in the direction of least resistance, which, in this circumstance, is further away from the closed position. The result is the resilience of the compression spring 412 within the bridge assembly 106 urging the door 108 to either remain beyond point D2 of FIG. 8 or urging the door 108 toward the closed position depending on where a user has manually moved the door relative to point D2.

A very popular type of hinge 116, which I anticipate will often be used in conjunction with my link assembly, opens to 120 degrees. In FIG. 8, the door 108 and toe kick plate 112 positions marked 108-120 and 112-120 represent the door with this type of hinge 116 having been opened to the maximum 120 degree range of the hinge 116. In the representative typical application demonstrated in FIG. 8, it can be seen that the resiliently biased, over-center behavior of my link assembly will urge the door to remain at the maximum open range of this typical 120 degree hinge 116.

FIG. 8 would look different if redrawn to represent certain other applications of my link assembly using a different type of hinge 116 and/or toe kick plate 112 configuration. Most significantly, points D1 and D3 would shift to different positions in response to changes in such variables. I have designed and tested my link assembly to accommodate changes in such variables.

Figure 9:
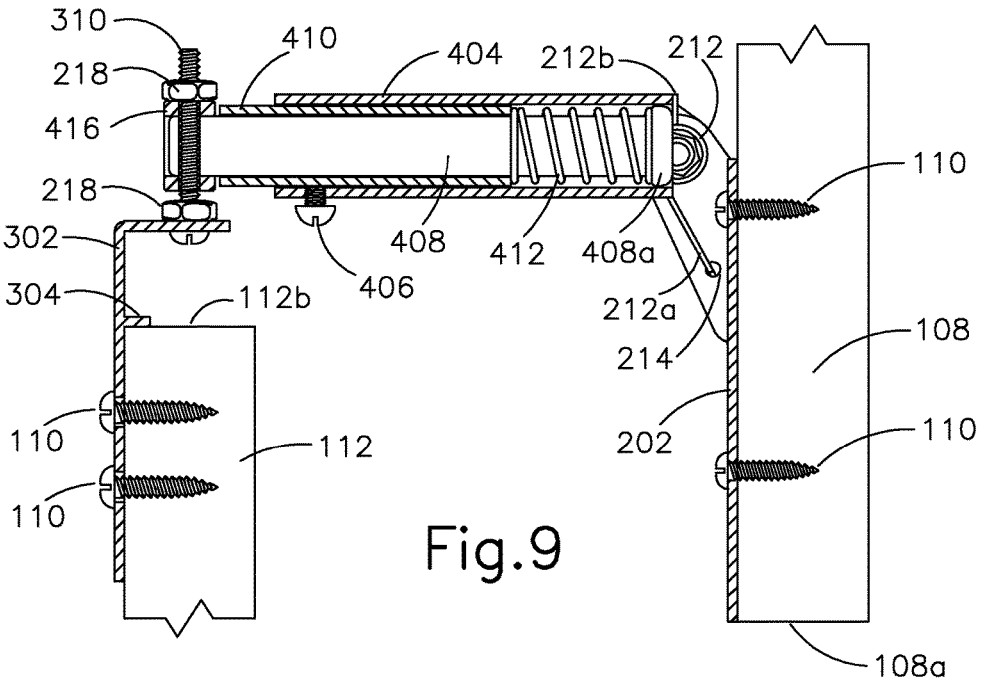
FIG. 9 is a cross-sectional view of my link assembly.

FIG. 9 is a cross-sectional view of my link assembly with the cross-section through the toe kick plate bracket assembly 104 rotated 90 degrees toward the plane of view for clarity. FIG. 9 shows the compression spring 412, in a non-compressed configuration, and the bridge pin 408 in a fully retracted configuration within the bridge barrel 404 as would be typical when the cabinet door 108 is outside the range of the crescent D of FIG. 8.

Figure 10:
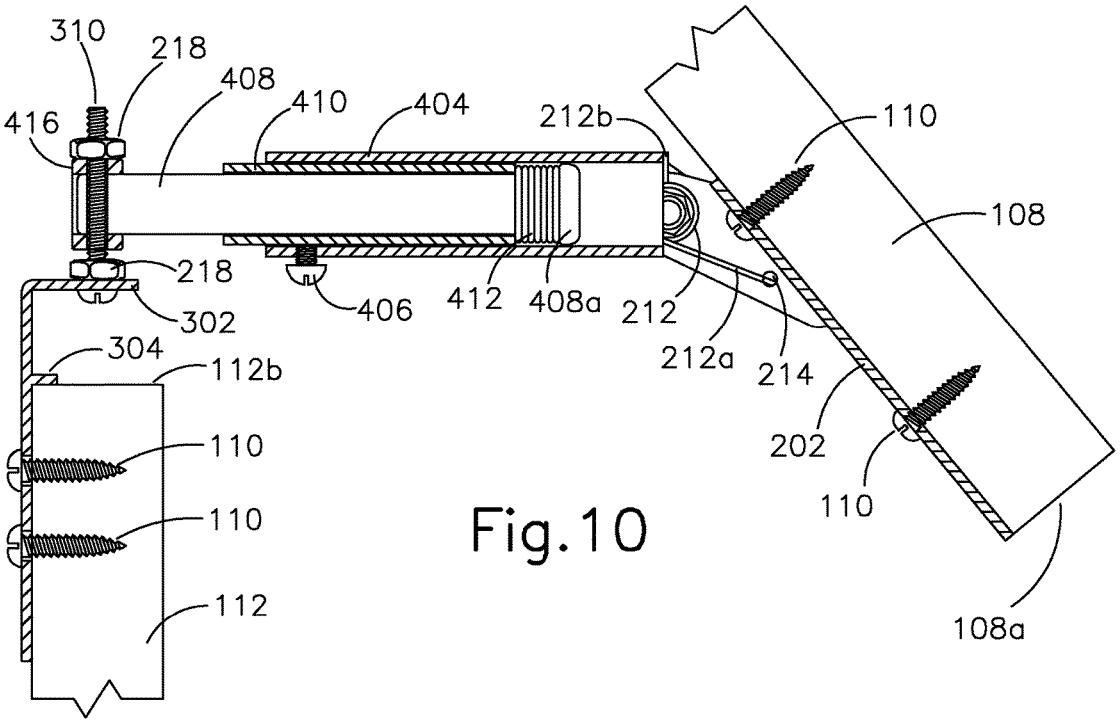
FIG. 10 is a cross-sectional view of my link assembly.

FIG. 10 is a cross-sectional view of my link assembly with the cross-section through the toe kick plate bracket assembly 104 rotated 90 degrees toward the plane of view for clarity. FIG. 10 shows the compression spring 412, in a compressed configuration, as well as the bridge pin 408 in an extended configuration as would be typical when the cabinet door 108 is near the 108-92 position of FIG. 8.

The purpose of the twin torsion springs 212 acting between the base segment 202 and the bridge segment 402 is to urge the bridge segment 402 away from a straightened posture and toward a folded posture to prevent my link assembly from becoming locked in a straightened posture and thus preventing the door 108 from being returned to its closed position. As previously described, the bridge segment 402 is pivotally attached to the base segment 202 by means of pivot pins 210 inserted through the aligned pivot pin apertures 206 on the intermeshed pivot bosses 204 of the bridge segment 402 and base segment 202. This resultant joint within my link assembly behaves much like a person's elbow while the person is performing the strengthening exercise known as "push ups".

For example, when a person doing push-ups is relaxed with their chest resting against the floor, their elbows are bent with the upper and lower segments of their arms meeting at their elbows at acute angles. As the person straightens their arms, their torso rises up from the floor until such point as their elbows become straight with the upper and lower segments of their arms becoming axially aligned. At this point, the person's elbows can be easily held in a straightened and "locked" condition with very little effort as their elbows gain a mechanical advantage permitting them to sustain significant force without collapsing back into a bent configuration. In my link assembly, as stated, the joint between the bridge segment 402 and base segment 202 behaves in much the same way as an elbow of a person engaged in doing a push-up. When the cabinet door 108 is closed, the bridge segment 402 and base segment 202 will typically form a 90 degree angle, or less, relative to each other. As the door 108 is opened, the joint between the bridge segment 402 and the base segment 202 straightens in the same way as a person's elbow straightens toward the top of push-up. I realized during my testing processes that, in certain applications, the joint between the bridge segment 402 and the base segment 202 could become "locked" in a straightened configuration preventing the cabinet door 108 from being closed. Therefore the torsion springs 212 are engaged in such a manner as to prevent this joint from becoming locked in a straightened configuration. The torsion springs 212 reach the maximum torsional stress thereof as the "elbow" is drawn into a straightened posture. When the cabinet door 108 is moved toward the closed position the tension which had drawn the "elbow" into a straightened posture is relieved allowing the torsion springs 212 to concurrently urge the bridge segment 402 and base segment 202 to fold back toward each other thus avoiding the occurrence of the "elbow lock" condition described.

FIG. 11 is a detail showing a torsion spring 212 of my link assembly wherein the torsion spring 212 is in a relaxed configuration as would be typical when the bridge segment 402 is rotated fully back against the base segment 202.

Figure 12:
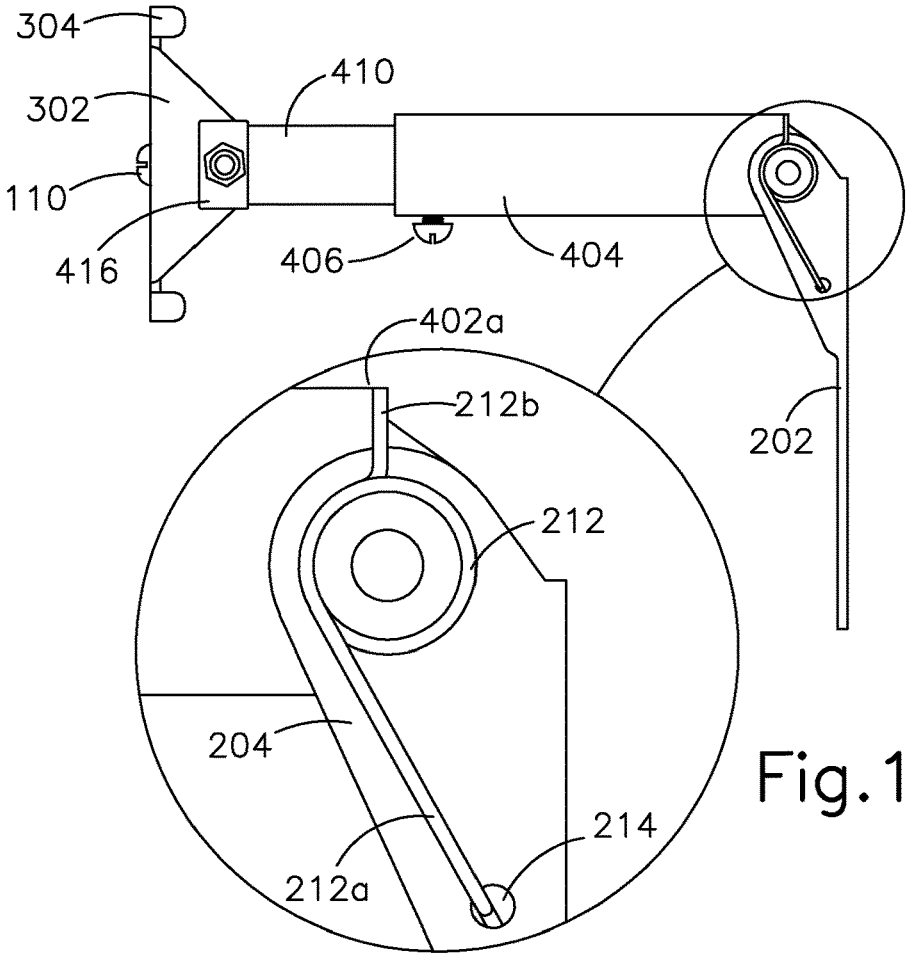
FIG. 12 is a detail showing a torsion spring of my link assembly.

FIG. 12 is a detail showing a torsion spring 212 of my link assembly wherein the torsion spring 212 has been loaded approximately 90 degrees as would be typical with my link assembly attached to a door 108 and toe kick plate 112 which are in the closed position.

FIG. 13 is a detail showing a torsion spring 212 of my link assembly wherein the torsion spring 212 is in its maximum load configuration at approximately 180 degrees as would be typical with my link assembly attached to a door 108 and toe kick plate 112 which are opened approximately 110 degrees.

FIG. 14 is a top view of my link assembly in a typical installation forming a mechanical link between a cabinet door 108 and toe kick plate 112. The bridge segment 402, being oriented as shown in FIG. 14, will be referred to as being in the "zero deflection" position. That is, when the bridge segment 402 forms an approximately 90 degree angle with the door 108. This figure includes a negative symbol adjacent to a leftward-pointing arrow which defines negative rotational directionality. FIG. 14 also includes a positive symbol adjacent to a rightward-pointing arrow which defines positive rotational directionality. This is important because, in certain applications, the link assembly will have to be installed with a deflection in the negative direction. Therefore, any alternate embodiment of my link assembly which cannot rotate into the negative deflection range would be limited to applications not requiring such rotation.

In conclusion, the main, upper portion of the cabinet interior cavity, which is blocked by the door 108 in its closed position, becomes accessible when the door 108 is opened. Concurrently, because of my link assembly which links the toe kick plate 112 to the door 108, the toe kick plate 112 follows the door 108 also swinging away from the closed position leaving the lower portion of the previously blocked cabinet interior cavity accessible and unobstructed. When the door 108 has been swung to a point of approximately 90 degrees open, the toe kick plate 112 will have also swung to a position which is underneath and nearly co-planar with the door 108. Conversely, when the door 108 is being closed, the toe kick plate 112 is concurrently urged toward its original closed position as well.

Description and Operation of Alternative Embodiments—FIGS. 15-24

Figure 15:
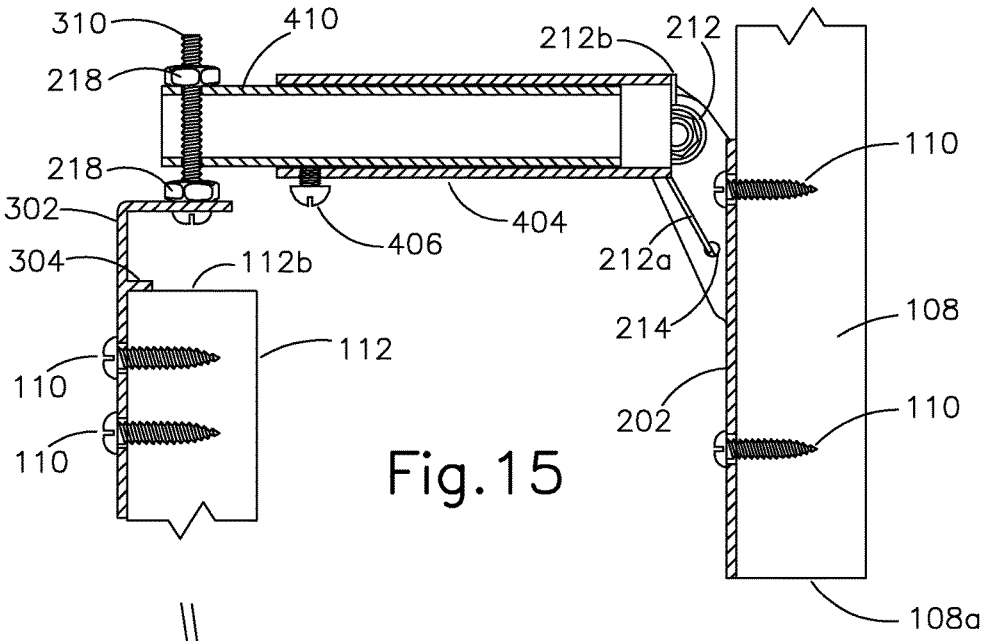
FIG. 15 is a cross-sectional view of one alternate embodiment of my link assembly.

FIG. 15 is a cross-sectional drawing of my link assembly having the cross-section through the toe kick plate bracket assembly 104 rotated 90 degrees toward the plane of view for clarity. FIG. 15 shows an embodiment of my link assembly which does not have the bridge pin 408, compression spring 412, or bumper 416 as previously described in the first embodiment. This alternate embodiment also functions successfully but is much more difficult to install and adjust properly because it requires precise positioning of the toe kick plate bracket 302 and precise adjustment of the bridge tube 410 within the bridge barrel 404. It requires both adjustments to be exactly precise in order to find the exact "sweet-spot" which will allow the door 108 to open and also place the toe kick plate 112 in the correctly adjusted position when the door 108 is closed. It is my conclusion, based on over thirty years of experience in cabinetry manufacturing, that there are very few people who would be willing and able to make these adjustments successfully. In addition, while the torsion springs 212 in this alternate embodiment, by themselves, do produce a limited resiliently biased door-hold-open effect, this effect is week and has limited effectiveness for holding the cabinet door 108 in the open position compared to what the compression spring 412 accomplishes in the first embodiment disclosed.

In a similar way as discussed above, an alternate embodiment of my link assembly could also function without the adjustability that comes from the bridge tube 410 being slidably adjustable within the bridge barrel 404. In other words, such an alternate version could be made to function even if the bridge assembly 106 was replaced with a one-piece, solid, non-adjustable bar which was pivotally attached by one of its ends to the base segment 202 and by the other of its ends to the toe kick plate bracket 302. This would be possible if such an alternate version was manufactured for a very specific application where all the particular attachment points were precisely controlled and did not vary from one installation to the next. Such a non-adjustable link assembly would work if the application was so precisely engineered that no adjustability within the link assembly was needed. Such a link assembly could possibly produce acceptable results in certain environments but would not be practical in general furniture and cabinetry manufacturing where highly adjustable hardware is a welcomed and appreciated commodity.

Figure 16:
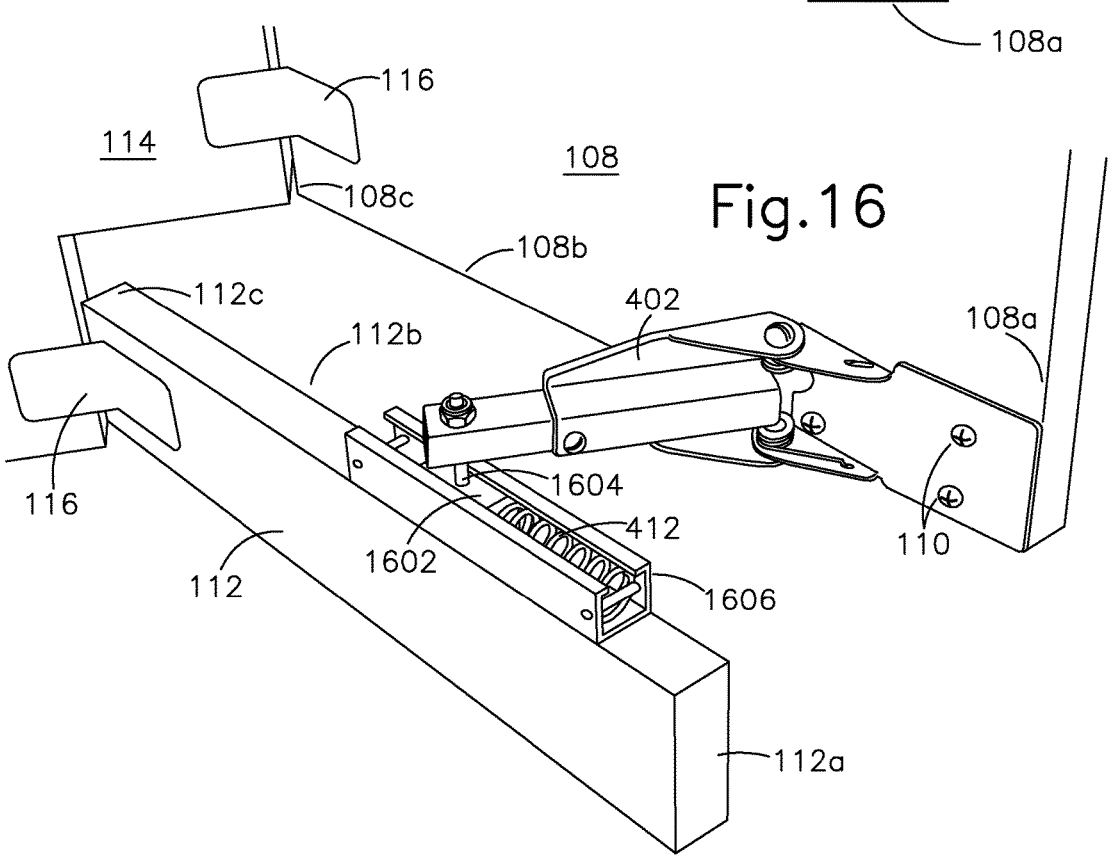
FIG. 16 is a perspective drawing of one alternate embodiment of my link assembly.

FIG. 16 is a perspective view of an additional alternate embodiment of my link assembly having the same base segment 202, torsion springs 212, bridge segment 402, set screw 406, and bridge tube 410 of the first embodiment performing the same functions as in the first embodiment. However the means for this alternate model to self-adjust dimensionally is significantly different from the comparable means shown in the first embodiment and the other alternate embodiments. In this model, the bridge tube 410 is pivotally attached to a block 1602 by means of a threaded block pivot pin 1604 and a self-locking hex nut 218. One end of the block pivot pin 1604 is fixedly attached to the block 1602 and the other end of the block pivot pin 1604 is pivotally inserted through a minor penetration in the bridge tube 410 the central axis of which being perpendicular to the lengthwise central axis of the bridge tube 410. The block 1602 is slidably captured within a c-channel 1606 which, in turn, is fixedly attached to the toe kick plate top edge 112*b*. The toe kick plate 112 has been modified to be narrower by an amount equal to the vertical width of the c-channel 1606. This modification will allow the top-most edge of the c-channel 1606 to pass below the door bottom edge 108*b* without the two components touching each other.

The c-channel 1606 may be an extruded metal profile or formed from sheet-metal or milled from solid stock or created by a molding process. The block 1602 is made from a material that will readily move slideably within the c-channel 1606 and, preferably, do so without adding a lubricant. Most likely however the block 1602 would be made from a plastic such as nylon or high density poly-ethylene (HDPE).

The slideable mechanism described in FIG. 16 produces the automatic dimensional self-adjustability in this link assembly and is only one possible means of making this slidable connection between the bridge assembly 106 and toe kick plate 112 of this alternate embodiment. I have experimented with additional designs and one skilled in the art will envision other ways to make a slidable connection between these two parts.

Also slideably captured within the c-channel 1606, between the block 1602 and the end of the c-channel 1606 nearest the the toe kick plate free-swinging edge 112*a*, is a compression spring 412. This compression spring 412 produces the resiliently biased, over-center, door-hold-open mechanism as shown in the first embodiment and described in FIG. 8. In this alternate version, when the cabinet door 108 is opened beyond the D1 point of FIG. 8, the compression spring 412 becomes compressed between the block 1602 and whatever means is acting to restrain the opposite end of the spring within the c-channel 1606. This compression increases up to the D2 point of FIG. 8 and, thereafter, decreases allowing the spring 412 to urge the door further toward the open position.

Figure 17:
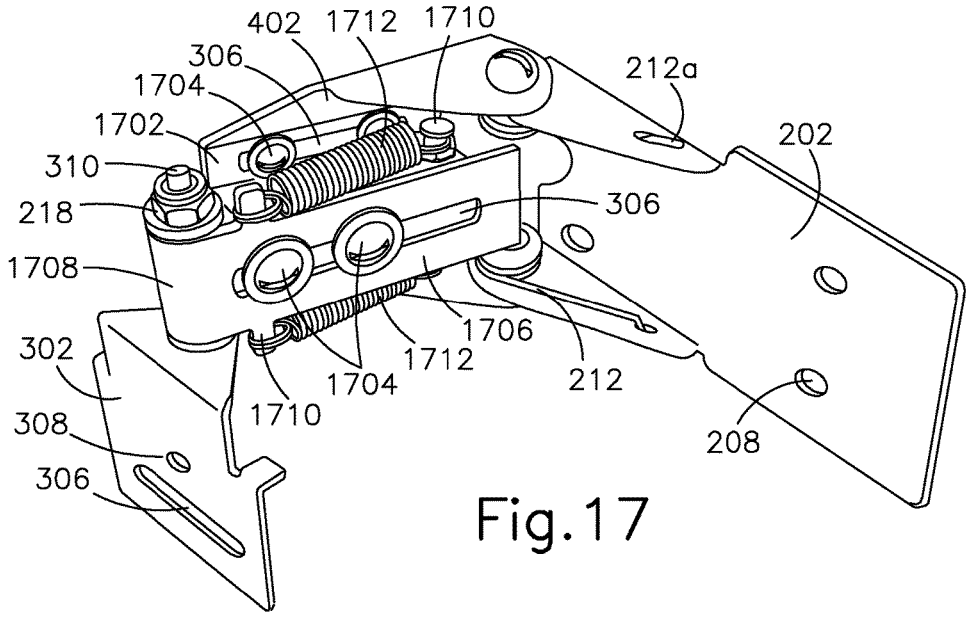
FIG. 17 is a perspective drawing of one alternate embodiment of my link assembly.

FIG. 17 is a perspective view of another alternate embodiment which I have successfully built and tested. Although having a significantly different appearance, this embodiment possesses the same essential elements as, and functions similarly to, the first embodiment of my link assembly. The bridge segment 402 has a mounting bracket 1702 slideably attached to it instead of the bridge barrel 404 of the first embodiment. I made the mounting bracket 1702 from 16 gauge sheet-metal although other materials such as an extruded metal, plastic or milled solid stock could function as well. This mounting bracket 1702 is the same length as the bridge barrel 404 of the first embodiment and has a hat-shaped cross-section with a slotted penetration 306 running lengthwise along the flat, turned-out, "brim part", on each side of the hat shape. The base segment 402 is drilled and tapped to receive truss-head machine screws 1704 passing through the slotted penetration 306 in the "brim part" of the mounting bracket 1702. These truss-head machine screws 1704 passing through this slotted penetration 306 produce a lengthwise adjustability for the mounting bracket 1702 having essentially the same purpose as the bridge tube 410 and set screw 406 of the first embodiment.

Slidably attached to the top of the hat-shaped mounting bracket 1702 is a slide-bar 1706 also made of a suitable gauge sheet-metal. The slide-bar 1706 also has a slotted penetration 306 running lengthwise down its centerline. One end of the slide-bar 1706 is rolled into a cylindrical shape to form a mounting boss 1708 to receive the toe kick plate bracket pivot pin 310. Passing through the slotted penetration 306 in the slide-bar 1706 and into the top of the mounting bracket 1702 are a pair of truss-head machine screws 1704. These machine screws 1704 are screwed into drilled and tapped penetrations in the top of the mounting bracket 1702 and also have hex-nuts screwed onto them within the void space under the hat-shaped mounting bracket 1702. The hex-nuts provide a locking method so that the truss-head machine screws 1704 passing through the slide-bar 1706 can be tightened to a desired depth and then locked at that depth, keeping them secure, while at the same time allowing the slide-bar 1706 to slide back and forth freely. In this way, the slide-bar 1706 serves the same function as the sliding bridge pin 408 in the first embodiment of my invention.

On the sides of the slide-bar 1706, adjacent to the mounting boss 1708, are two ear-like protrusions which serve as attachment posts 1710 for a pair of extension springs 1712. Affixed to the two sides of the mounting bracket 1702, at the end of the mounting bracket 1702 nearest to the base segment 202, are a pair of flanged studs which serve as an additional pair of attachment posts 1710 for the extension springs 1712. Once in place, these extension springs serve the same function as the compression spring 412 of the first embodiment.

Figure 18:
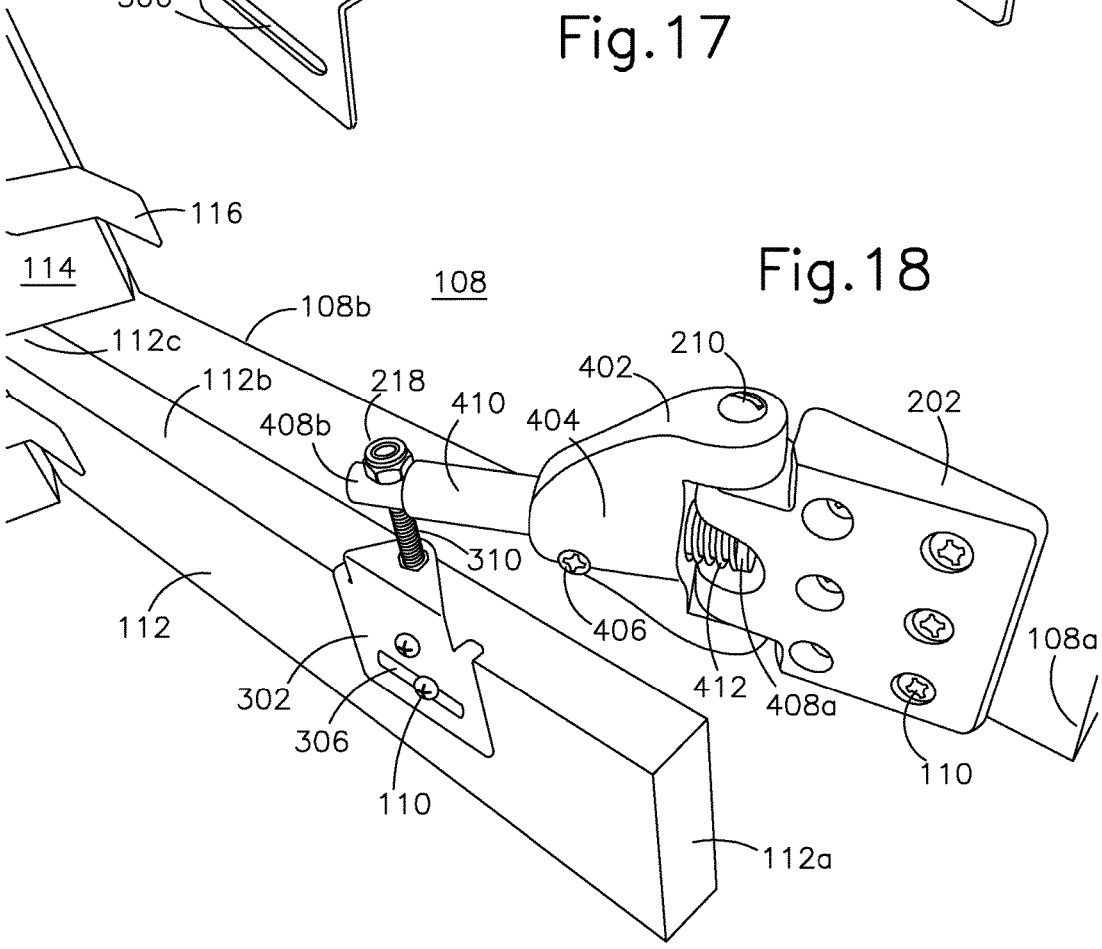
FIG. 18 is a perspective drawing of one alternate embodiment of my link assembly.

FIG. 18 shows an embodiment of my link assembly made largely of wood which I have also successfully built and tested. Although the base segment 202 and bridge segment 402 appear different, not being made from sheet-metal, this alternate embodiment can have all the same basic parts and function in the same way as the first embodiment. This model could have also been produced from processes such as mold-formed materials or milling from solid stock materials other than wood. This is a strong and excellent design and, if fabricated from wood, may be very well received by a market desiring an all-wood look in their cabinetry.

FIGS. 19 and 20 show an additional design for my link assembly incorporating a pantograph mechanism which consists of a plurality of linkage elements pivotally attached to each other with a plurality of fixed rivets at the points where the linkage elements cross each other. This link assembly consists of the multi-segmented pantograph device 1902 which is pivotally attached to a dual-pivot mounting bracket 1904 which, in turn, is fixedly attached to the door 108 by driving an appropriate screw fastener 110 into the door through each of the affixing apertures 208 in the mounting bracket 1904. At its other end, the pantograph device is pivotally attached to a dual pivot flange 1906 on an alternate embodiment of a bridge barrel 404 having a set screw 406 in the side of it. Slideably inserted through this bridge barrel 404 is a modified bridge pin 1908 which has the same eye 414 but not the head 408*a* of the bridge pin 408 in the first embodiment. This embodiment is complete when pivotally attached to the toe kick plate bracket 302 by means of the toe kick plate bracket pivot pin 310 and self-locking hex nut 218 as described previously in the first embodiment of my invention.

FIG. 19 shows the pantograph linkage 1902 fully extended as would be seen when the cabinet door 108 has been fully opened. FIG. 20 shows the pantograph linkage retracted into a collapsed configuration as would be seen when the cabinet door 108 has been fully closed.

FIGS. 21-24 show a seventh alternate embodiment of my link assembly.

Upon first inspection, this embodiment appears significantly different from the first embodiment but, in fact, possesses most of the same essential parts and functions in virtually the same way as the first embodiment. This is a very excellent alternate embodiment which ran a close second in my deliberations to decide which embodiment I would name as the first embodiment of my link assembly in this patent application.

Figure 23:
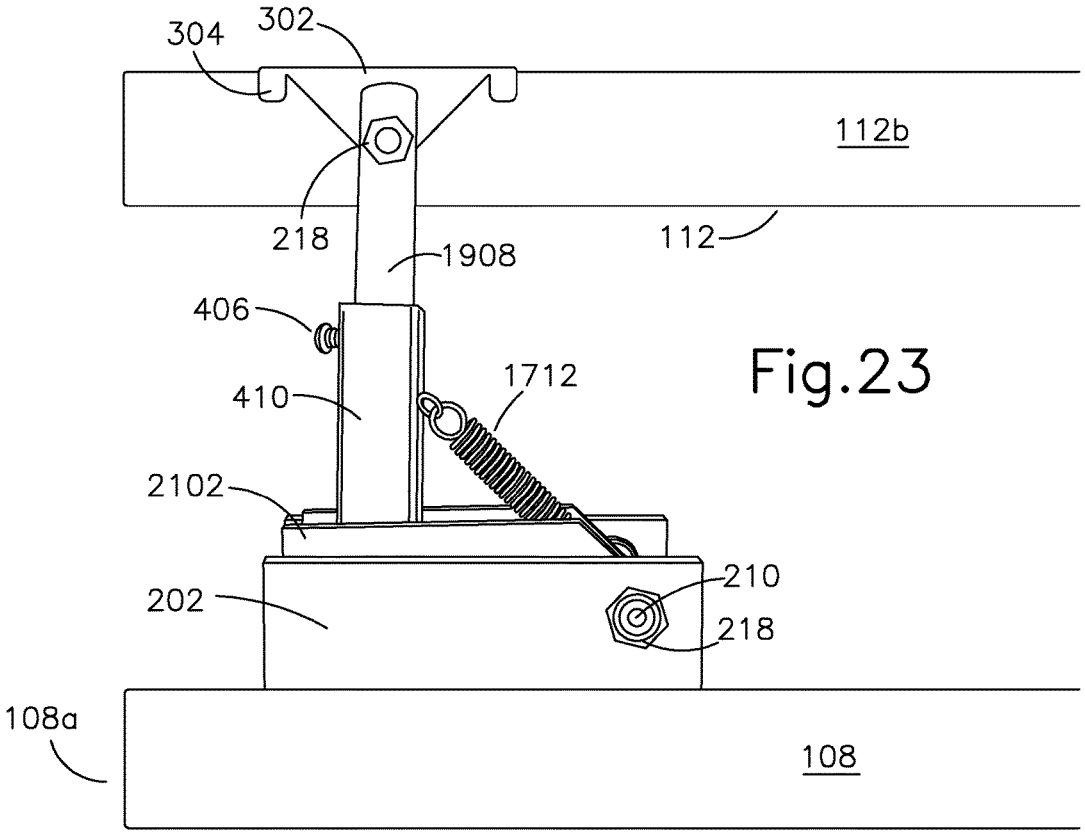
FIG. 23 is a top view drawing of one alternate embodiment of my link assembly.
Figure 24:
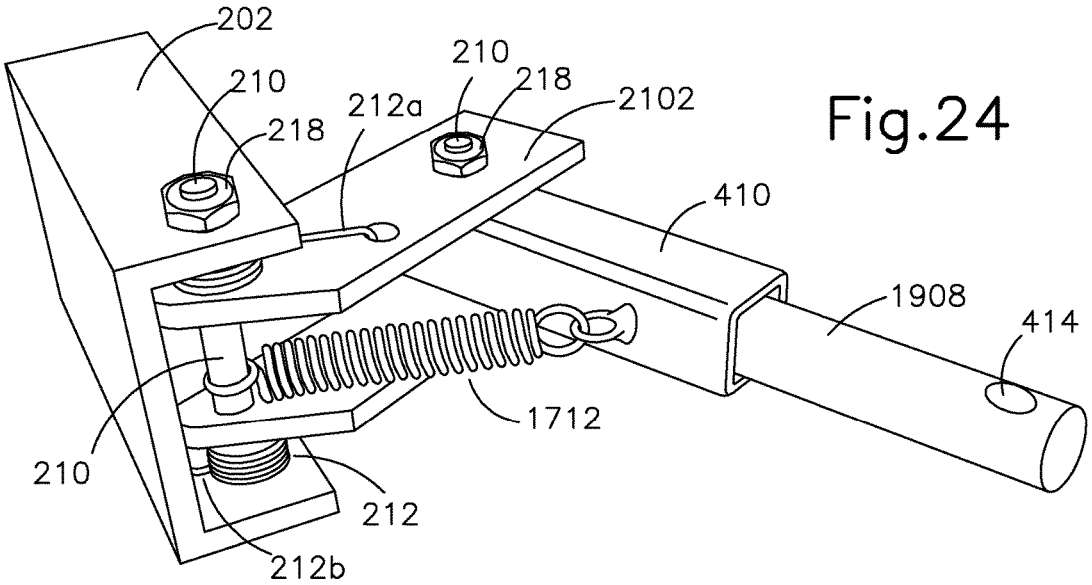
FIG. 24 is a perspective drawing of one alternate embodiment of my link assembly.

The base segment 202, bridge tube 410, set screw 406, toe kick plate bracket 302, toe kick plate bracket pivot pin 310, pivot pins 210, hex nuts 218, and screw fasteners 110 of FIGS. 21 through 24 all perform the same functions as previously described. In this embodiment, the base segment 202 and the modified bridge segment 2102 are made from sections of extruded aluminum channel-stock but could have also been made from formed sheet-metal, extruded plastic stock, or milled from various solid stock materials. As shown in FIG. 24, this link assembly possesses torsion springs 212 which perform the desirable function of urging the modified bridge segment 2102 toward the space between the sidewalls of the base segment 202 and thus producing the same anti-elbow-lock feature shown in the first embodiment. The difference between the outside dimension of the modified bridge segment 2102 and the inside dimension of the base segment 202 must allow clearance for the torsion springs 212. There are spacers within the coils of the torsion springs 212 which act to keep the modified bridge segment 2102 centered between the sidewalls of the base segment 202 and thus maintaining the required clearance for each torsion spring 212 to function correctly.

The dimensions of the modified bridge segment 2102 allow the bridge tube 410 to fit inside of it. The inside dimension of the bridge tube 410 allows the modified bridge pin 1908 to fit slideably within it with minimal lateral play. The modified bridge pin 1908, as first shown in FIG. 19, is the same as the bridge pin 408 with the exception of not having the head 408*a*.

The base segment 202, modified bridge segment 2102 and bridge tube 410 are pivotally connected by pivot pins 210 passing through pivot pin apertures 206 prepared therein. An extension spring 1712 is rotatably attached by one of its ends to the shaft of the pivot pin 210 which connects the base segment 202 to the modified bridge segment 2102. The other end of the extension spring 1712 is rotatably attached to the bridge tube 410 on the side opposite from where the set screw 406 is located. As shown in FIG. 23, the extension spring 1712 urges the bridge tube 410 toward the positive deflection range as described in FIG. 14 but the bridge tube 410 is mechanically limited so that it cannot move in that direction. It is only free to rotate toward the negative deflection range as described in FIG. 14.

The operation of this embodiment is as follows: As shown in FIG. 23, when the cabinet door 108 is in the closed position, the modified bridge segment 2102 lies between the side walls of the base segment 202 and parallel to the back of the cabinet door 108 and the bridge tube 410 projects rearward away from the back of the door 108 at approximately a 90 degree angle toward the toe kick plate 112. The modified bridge pin 1908 is pivotally attached to the toe kick plate 112 in the same manner as described in the first embodiment with the exception of not using the bumper 416. The distance between the door 108 and the toe kick plate 112 is set by slideably adjusting the modified bridge pin 1908 into or out from the bridge tube 410 and affixing its position with the set screw 406.

As the door is opened, the bridge assembly 106 begins to rotate outwards from its resting position as shown in FIG. 21. This rotation places ever-increasing tension on the torsion springs 212 and charges them to urge the modified bridge segment 2102 back toward its original resting position. At a certain point, as previously described with regard to the first embodiment, and shown in FIG. 8, the tension forces acting across the bridge assembly 106 will begin to draw the elbow-like joint between the modified bridge segment 2102 and bridge tube 410 outwards toward a straightened configuration as shown in FIG. 22. The straightening of this elbow-like joint places increasing tension on the extension spring 1712 which produces the same desirable results as does the increased compression on the compression spring 412 in the first embodiment. This tension produces an over-center biasing effect which will urge the door 108 to remain in the open position once the door 108 is opened beyond the D2 position as described in FIG. 8. This tension will also urge the modified bridge segment 2102 back toward its original position when the door 108 is being closed.

Ramifications

Figure 25:
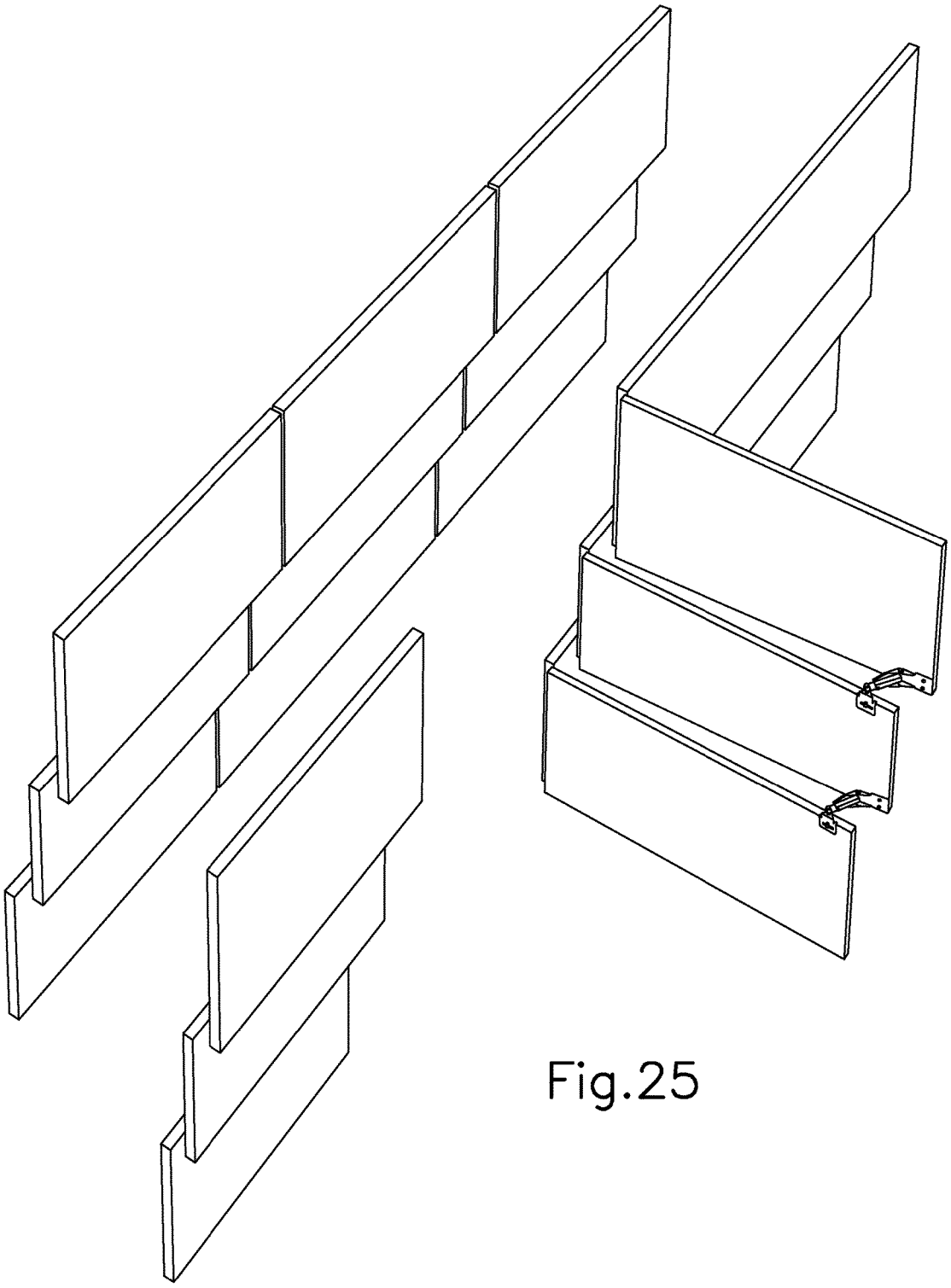
FIG. 25 is a perspective drawing of one ramification of my link assembly.

FIG. 25 is a perspective drawing of an alternate ramification of my link assembly. The stepped-down-and-back panel design shown in FIG. 25 is often seen on the outside faces of architectural millwork projects such as reception desks, security stations, nurse stations, courtroom furnishings and the like. Without my link assembly, there have been very few options if an architect or designer wanted to have a door or gate through a wall of this design. But as shown in FIG. 25, using my link assembly, a wall of this design could be built with a matching, flush, built-in gate or door. FIG. 25 shows a wall design with only three horizontal panels but, in reality, the wall could have more rows of panels than this and they could be specified in an assortment of widths. Incorporating my link assembly would make installing and adjusting such a system relatively simple and would produce a very distinctive end-result.

Additionally, my link assembly may be readily scaled to any size for use on hinged panels of larger or smaller dimensions than those typically occurring in standard cabinetry.

That which is claimed is:

1. A link assembly connecting a first member to a second member, the link assembly comprising:

a first tube having a first end, a second end, a first axis, an inside surface and an inside diameter, the first end of the first tube having a centerpoint, the second end of the first tube having a centerpoint, the first axis defined by a line passing through both the centerpoint of the first end of the first tube and the centerpoint of the second end of the first tube, the inside diameter of the first tube defined by a length of a shortest line originating at a first point on the inside surface of the first tube intersecting the first axis perpendicularly and terminating at a second point on the inside surface of the first tube, the first end of the first tube configured to join rotatably to the first member about a second axis, the first axis and the second axis are disposed in a generally perpendicular relationship;

a second tube having a first end, a second end, an axis, an inside surface and an inside diameter, the first end of the second tube having a centerpoint, the second end of the second tube having a centerpoint, the axis of the second tube defined by a line passing through both the centerpoint of the first end of the second tube and the centerpoint of the second end of the second tube, the inside diameter of the second tube defined by a length of a shortest line originating at a first point on the inside surface of the second tube intersecting the axis of the second tube perpendicularly and terminating at a second point on the inside surface of the second tube, the second tube configured to fit slidably within the first tube; and a first shaft having a first end, a second end, an axis, an outside surface and an outside diameter, the first end of the first shaft having a centerpoint, the second end of the first shaft having a center-point, the axis of the first shaft defined by a line passing through both the centerpoint of the first end of the first shaft and the centerpoint of the second end of the first shaft, the first shaft outside diameter defined by a length of a longest line originating at a point on the outside surface of the first shaft intersecting the axis of the first shaft perpendicularly and terminating at a second point on the outside surface of the first shaft, the first shaft configured to fit slidably within the second tube.

2. The link assembly of claim 1, wherein the first shaft comprises at least one aperture having a first end, a second end and an axis, the first end of the at least one aperture of the first shaft having a centerpoint, the second end of the at least one aperture of the first shaft having a centerpoint, the axis of the at least one aperture of the first shaft defined by a line passing through both the centerpoint of the first end of the at least one aperture of the first shaft and the centerpoint of the second end of the at least one aperture of the first shaft, the axis of the first shaft and the axis of the at least one aperture of the first shaft are disposed in a generally perpendicular relationship.

3. The link assembly of claim 1, wherein the first end of the first shaft comprises an enlarged portion having an outside diameter and an outside surface, the outside diameter of the enlarged portion of the first shaft defined by a length of a longest line originating on the outside surface of the enlarged portion of the first shaft intersecting the axis of the first shaft perpendicularly and terminating on the outside surface of the enlarged portion of the first shaft, the outside diameter of the enlarged portion of the first shaft being greater than the inside diameter of the second tube and less than the inside diameter of the first tube.

4. The link assembly of claim 1, wherein the first tube comprises at least one aperture, the at least one aperture of the first tube being internally threaded to receive an externally threaded fastener having a matching thread specification.

5. The link assembly of claim 1, wherein the second tube is positioned slidably within the first tube.

6. The link assembly of claim 1, wherein an externally threaded fastener is threadably inserted through at least one aperture of the first tube and contacting the second tube, whereby the position of the second tube within the first tube is adjustably fixed.

7. The link assembly of claim 1, further comprising:

a second shaft having a first end and a second end, the second shaft being externally threaded to receive an internally threaded fastener having a matching thread specification, the second shaft configured to fit slidably in at least one aperture of the first shaft, the second end of the second shaft fixedly attached to the second member; and a compression spring having a first end, a second end, a plurality of coils, an inside diameter and an outside diameter, the inside diameter of the compression spring being greater than the outside diameter of the first shaft, the inside diameter of the compression spring being less than an outside diameter of an enlarged portion of the first end of the first shaft, the outside diameter of the compression spring being less than the inside diameter of the first tube.

8. The link assembly of claim 7, wherein the first end of the compression spring contacts the enlarged portion of the first shaft, the plurality of coils of the compression spring surrounds the first shaft, the first shaft is slidably positioned inside the second tube and the first end of the second tube contacts the second end of the compression spring whereby the second tube is biased away from the enlarged portion of the first shaft.

9. The link assembly of claim 7, wherein the second shaft is slidably positioned in the at least one aperture in the first shaft, whereby the second tube is held in contact with the second end of the compression spring.

10. The link assembly of claim 9, wherein an internally threaded fastener is threadably positioned on the first end of the second shaft, whereby the second shaft is slidably fixed within the at least one aperture in the first shaft.

* * * * *